US009435101B2

(12) United States Patent
Zhdanov et al.

(10) Patent No.: US 9,435,101 B2
(45) Date of Patent: Sep. 6, 2016

(54) SEMI-AUTOMATIC CONTROL OF A JOYSTICK FOR DOZER BLADE CONTROL

(71) Applicant: Topcon Positioning Systems, Inc., Livermore, CA (US)

(72) Inventors: Alexey Vladislavovich Zhdanov, Moscow (RU); Stanislav Georgievich Saul, Moscow (RU); Alexey Andreevich Kosarev, Moscow (RU); Ivan Giovanni di Federico, Argenta (IT); Anton Gennadievich Golovanov, Moscow (RU)

(73) Assignee: Topcon Positioning Systems, Inc., Livermore, CA (US)

( * ) Notice: Subject to any disclaimer, the term of this patent is extended or adjusted under 35 U.S.C. 154(b) by 50 days.

(21) Appl. No.: 14/260,646

(22) Filed: Apr. 24, 2014

(65) Prior Publication Data

US 2015/0308074 A1 Oct. 29, 2015

(51) Int. Cl.

| | |
|---|---|
| ***E02F 3/84*** | (2006.01) |
| ***E02F 9/20*** | (2006.01) |
| ***E02F 9/26*** | (2006.01) |

(52) U.S. Cl.

CPC ..... *E02F 3/844* (2013.01); *E02F 3/841* (2013.01); *E02F 3/845* (2013.01); *E02F 3/847* (2013.01); *E02F 9/2012* (2013.01); *E02F 9/264* (2013.01)

(58) Field of Classification Search

CPC ..... G01S 19/14; G01S 19/36; G01S 19/37; G01S 19/22; G01S 19/53; G01S 19/05; G01S 19/30; G01S 19/33; G01S 5/0036; G01S 15/87; G01S 19/13; G01S 19/23; G01S 19/254; G01S 19/256; G01S 19/258; G01S 19/44; G01S 19/48; G01S 19/49; G01S 19/51; G01S 19/55

See application file for complete search history.

(56) References Cited

U.S. PATENT DOCUMENTS 5,883,346 A * 3/1999 Stocken ..... H01H 25/00 200/18
5,917,593 A * 6/1999 Hirano ..... E02F 3/847 356/247

(Continued)

FOREIGN PATENT DOCUMENTS

JP 08249080 9/1996
JP 2005182679 7/2005

(Continued)

OTHER PUBLICATIONS

International Search Report and Written Opinion dated May 16, 2013, issued for application No. PCT/US2013/030352, 10 pgs.

(Continued)

*Primary Examiner* — Truc M Do

(74) *Attorney, Agent, or Firm* — Chiesa, Shahinian & Giantomasi PC

(57) ABSTRACT

On a dozer, a semi-automatic system automatically translates a joystick to control blade elevation and provides an indicator display to guide manual control of blade slope angle. A mechanical linkage operably couples the joystick to an electrical motor. A computational system receives measurements from measurement units mounted on the dozer; calculates estimated values of elevation and slope angle; compares the estimated values to reference values; and calculates error and control signals. Drivers generate a motor drive signal and a display drive signal. In response to the motor drive signal, the electrical motor translates the joystick to control elevation. In response to the display drive signal, the indicator display generates a graphical representation of the status of slope angle. When the operator needs to take manual control, a proximity sensor detects the presence of at least a portion of the operator's hand, wrist, or forearm and disengages automatic control of elevation.

16 Claims, 21 Drawing Sheets

(56) References Cited

U.S. PATENT DOCUMENTS 7,439,460 B1 * 10/2008 Watson ..... B60R 16/005 200/18
8,757,315 B1 * 6/2014 Wuisan ..... F16H 59/02 180/315
8,878,657 B2 * 11/2014 Periquet ..... F16F 9/535 188/267
9,059,644 B2 * 6/2015 Kobayashi ..... H02M 7/53873
2004/0011154 A1 * 1/2004 Dybro ..... E02F 9/2004 74/473.3
2006/0065467 A1 * 3/2006 Schuh ..... B60K 17/10 180/305
2007/0074511 A1 * 4/2007 Verkuilen ..... E02F 9/2203 60/486
2008/0065297 A1 * 3/2008 Brickner ..... E02F 9/2203 701/50
2009/0031891 A1 * 2/2009 Brinkman ..... E02F 9/2004 91/433
2009/0069987 A1 * 3/2009 Omelchenko ..... E02F 3/842 701/50
2009/0174396 A1 * 7/2009 Howard ..... G01D 5/2053 324/207.24
2009/0225027 A1 * 9/2009 Itoh ..... G05G 1/02 345/161
2010/0011903 A1 1/2010 Koschke et al.
2010/0154400 A1 * 6/2010 Krajnik ..... E02F 9/2235 60/327
2010/0254793 A1 * 10/2010 Trifunovic ..... E02F 3/432 414/700
2010/0299031 A1 * 11/2010 Zhdanov ..... E02F 3/0845 701/50
2012/0323451 A1 * 12/2012 Shatters ..... E02F 3/432 701/50
2013/0204499 A1 * 8/2013 Buckmier ..... E02F 3/844 701/50
2013/0261902 A1 * 10/2013 Zhdanov ..... E02F 3/7613 701/50

FOREIGN PATENT DOCUMENTS

WO 2011078431 A1 6/2011
WO 2013119140 A1 8/2013

OTHER PUBLICATIONS

Extended Search Report mailed Oct. 26, 2015, in connection with European Patent Application No. 15168627.6, 5 pgs.

* cited by examiner

FIG. 2B
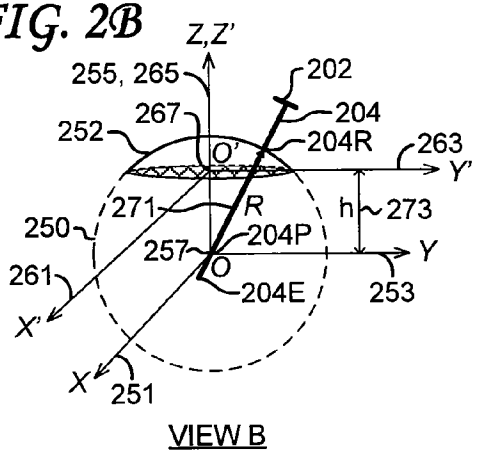
VIEW B
FIG. 2C
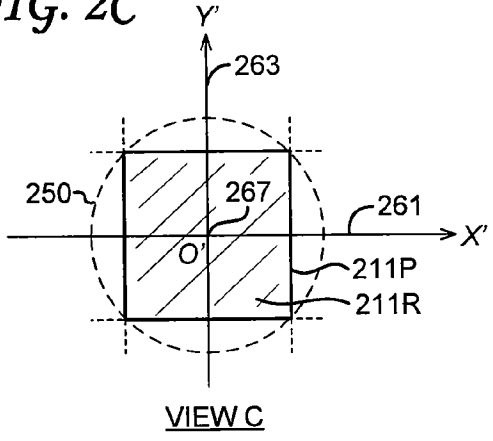
VIEW C
FIG. 2D
VIEW D
FIG. 2E
VIEW E

SEMI-AUTOMATIC CONTROL OF A JOYSTICK FOR DOZER BLADE CONTROL

BACKGROUND OF THE INVENTION

The present invention relates generally to machine control, and more particularly to semi-automatic control of a joystick for dozer blade control.

Automatic control systems for dozers have become increasingly popular in the construction equipment market. In an automatic control system, the position and orientation of the working implement (blade) of the dozer is determined with respect to a design surface; the blade is then automatically moved in accordance with the design surface. Automatic control systems are used, for example, to accurately produce design surfaces for the construction of building foundations, roads, railways, canals, and airports.

Automatic control systems have several advantages over manual control systems. First, manual control systems generally require more highly-skilled operators than automatic control systems: proper training of operators for manual control systems is both expensive and time-consuming. Second, automatic control systems increase the productivity of the machine by increasing the operational speed, permitting work in poor visibility conditions, avoiding downtime due to manual surveying of the site, and reducing the number of passes needed to produce the design surface. Third, automatic control systems reduce consumption of fuel as well as consumption of construction materials (construction standards call for a minimum thickness of paving material such as concrete, asphalt, sand, and gravel to be laid down; if the underlying surface is inaccurately graded, excess paving material needs to be laid down to ensure that the minimum thickness is met).

The operating principle of an automatic control system is based on the estimation of the current position and orientation of the dozer blade edge with respect to a reference surface defined by a specific project design. The reference surface can be specified in several ways. For example, the reference surface can be represented by a mathematical model, referred to as a digital terrain model (DTM), comprising an array of points connected by triangles. The reference surface can also be specified by natural or artificial surfaces and lines. A physical road surface is an example of a natural surface that can be used as a reference surface: the physical road surface can be used as the target for the next layer. Artificial surfaces and lines can be created, for example, by a laser plane or by metal wires installed on stakes.

The position and orientation of the blade can be determined from measurements by various sensors mounted on the dozer body and blade. Examples of sensors include global navigation satellite system (GNSS) sensors to measure positions; an optical prism to measure position with the aid of a laser robotic total station; electrolytic tilt sensors to measure angles; potentiometric sensors to measure angles and distances; microelectromechanical systems (MEMS) inertial sensors, such as accelerometers and gyros, to measure acceleration and angular rate, respectively; ultrasonic sensors to measure distances; laser receivers to receive signals from a laser transmitter and to measure vertical offsets; and stroke sensors to measure the extension of hydraulic cylinders.

Measurements from the various sensors are processed by a control unit to determine the position and orientation of the blade. The measured position and measured orientation of the blade are compared with the target position and target orientation, respectively, calculated from the reference surface. Error signals calculated from the difference between the measured position and the target position and the difference between the measured orientation and the target orientation are used to generate control signals. The control signals are used to control a drive system that moves the blade to minimize the error between the measured position and the target position and to minimize the error between the measured orientation and the target orientation.

The position and orientation of the blade are controlled by hydraulic cylinders. A valve controls the flow rate of hydraulic fluid, which, in turn, controls the velocity of a hydraulic cylinder (the velocity of the hydraulic cylinder refers to the time rate of change of the extension of the hydraulic cylinder). Valves can be manual or electric. For current automatic control systems, electric valves are used, and the control signals are electric signals that control the electric valves.

If a dozer is currently outfitted with manual valves, retrofitting the dozer with electric valves can be a complex, time-consuming, and expensive operation. In addition to modification of the valves, the hose connections to the pump, tank, and cylinder lines need to be disconnected and reconnected; retrofitting operations can take up to two days. As an added complication, in some instances, retrofitting an existing dozer may not be permitted by the manufacturer under terms of sale and may void the warranty for the dozer.

Even if the dozer is already outfitted with electric valves, the interface to the controller for the electric valves can be proprietary. The manufacturer of the dozer can restrict access to the interface specification needed by the construction contractor to install a custom automatic control system. And again, in some instances, retrofitting an existing dozer with an automatic control system not supplied by the manufacturer may not be permitted by the manufacturer under terms of sale and may void the warranty for the dozer.

Construction contractors can of course purchase dozers with electric valves and automatic control systems installed by the dozer manufacturer. In some instances, however, construction contractors lease or rent dozers, and the dozers available for lease or rent may not have suitable automatic control systems. Construction contractors may also wish to retrofit existing manually-controlled dozers with automatic control systems or to upgrade automatic control systems supplied by the dozer manufacturer with custom automatic control systems, which can have different capabilities or lower cost than the automatic control systems supplied by the dozer manufacturer.

BRIEF SUMMARY OF THE INVENTION

A joystick controls an implement operably coupled to a vehicle body: a first translation of the joystick controls a first degree of freedom of the implement and a second translation of the joystick controls a second degree of freedom of the implement. According to an embodiment of the invention, the joystick is controlled by a system that automatically translates the joystick to control the first degree of freedom and that provides an indicator display to guide manual control of the second degree of freedom. When an operator needs to take manual control of the joystick, the system automatically disengages the automatic control of the first degree of freedom.

The system includes at least one measurement unit, a proximity sensor, a computational system, a motor driver, a mechanical linkage, an electrical motor, a display driver, and an indicator display. The mechanical linkage is operably coupled to the joystick and operably coupled to the electrical motor. The at least one measurement unit, which is mounted on the vehicle body, on the implement, or on both the vehicle body and the implement, generates at least one plurality of measurements. The proximity sensor can detect the presence of at least a portion of an operator's hand, wrist, or forearm: when it does not detect the presence of at least a portion of an operator's hand, wrist, or forearm, it generates a first object detection signal; when it does detect the presence of at least a portion of an operator's hand, wrist, or forearm, it generates a second object detection signal.

The computational system receives the at least one plurality of measurements; calculates, based at least in part on the at least one plurality of measurements, an estimated value of the first degree of freedom; and calculates, based at least in part on the estimated value of the first degree of freedom and a reference value of the first degree of freedom, an error signal corresponding to the first degree of freedom. In response to receiving the first object detection signal, the computational system calculates, based at least in part on the error signal corresponding to the first degree of freedom, a first motor control signal.

Furthermore, the computational system calculates, based at least in part on the at least one plurality of measurements, an estimated value of the second degree of freedom; calculates, based at least in part on the estimated value of the second degree of freedom and a reference value of the second degree of freedom, an error signal corresponding to the second degree of freedom; and calculates, based at least in part on the error signal corresponding to the second degree of freedom, a display control signal corresponding to the second degree of freedom.

In response to receiving the first motor control signal, the motor driver generates a first motor drive signal. In response to receiving the first motor drive signal, the electrical motor automatically controls the mechanical linkage to translate along a first automatically-controlled mechanical linkage trajectory and automatically controls the joystick to translate along a first automatically-controlled joystick trajectory corresponding to the first automatically-controlled mechanical linkage trajectory; the translation speed of the joystick has a first maximum value.

In response to receiving the display control signal corresponding to the second degree of freedom, the display driver generates a display drive signal corresponding to the second degree of freedom. In response to receiving the display drive signal corresponding to the second degree of freedom, the indicator display displays a graphical representation of the difference between the estimated value of the second degree of freedom and the reference value of the second degree of freedom.

These and other advantages of the invention will be apparent to those of ordinary skill in the art by reference to the following detailed description and the accompanying drawings.

BRIEF DESCRIPTION OF THE DRAWINGS

FIG. 2B-FIG. 2E show schematics of the operational geometry of a joystick;

DETAILED DESCRIPTION

Embodiments of the invention described herein are applicable to semi-automatic control systems for controlling the position and orientation of an implement mounted on a vehicle; the implement is operably coupled to the vehicle body. Examples of vehicles outfitted with an implement include a dozer outfitted with a blade, a motor grader outfitted with a blade, and a paver outfitted with a screed. In the detailed discussions below, a dozer outfitted with a blade is used to illustrate embodiments of the invention.

Figure 1A:
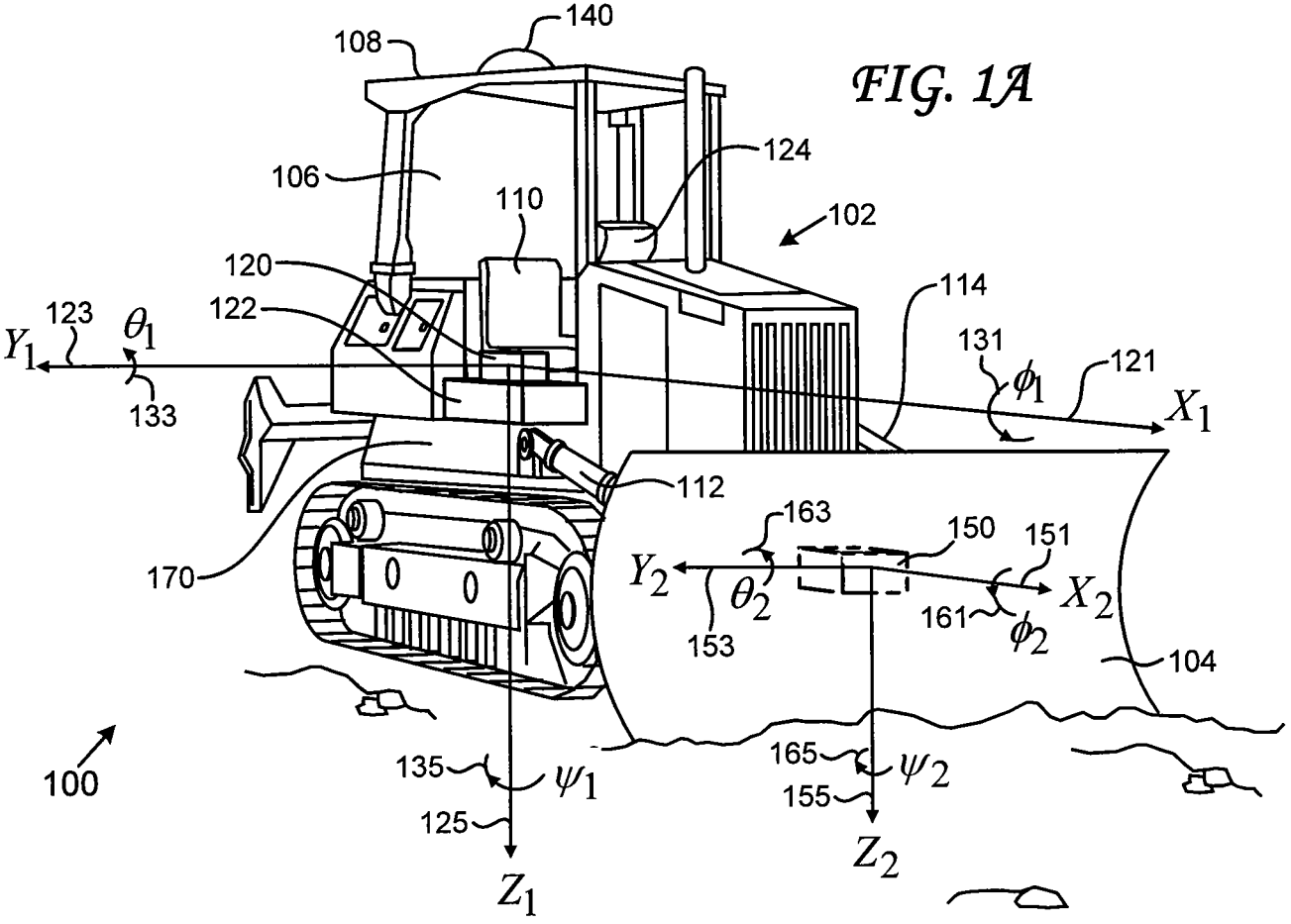
FIG. 1A shows a schematic of a dozer, a reference frame fixed to the dozer body, and a reference frame fixed to the blade.

FIG. 1A shows a schematic view of a dozer 100, which includes the dozer body 102 and the blade 104. The blade 104 is operably coupled to the dozer body 102 via hydraulic cylinders. The number of hydraulic cylinders depends on the dozer design. In one common configuration, a pair of hydraulic cylinders, referenced as the hydraulic cylinder 112 and the hydraulic cylinder 114, drives the blade 104 up and down; a separate hydraulic cylinder, not shown, rotates the blade to vary the blade slope angle.

Shown in FIG. 1A are two Cartesian coordinate systems (reference frames). The body coordinate system, fixed to the dozer body 102, is specified by three orthogonal coordinate axes: the $X_1$-axis 121, the $Y_1$-axis 123, and the $Z_1$-axis 125. Similarly, the blade coordinate system, fixed to the blade 104, is specified by three orthogonal coordinate axes: the $X_2$-axis 151, the $Y_2$-axis 153, and the $Z_2$-axis 155.

The rotation angle about each Cartesian coordinate axis follows the right-hand rule. Specific rotation angles are referenced as follows. In the body coordinate system, the rotation angle about the $X_1$-axis (body roll angle) is $\phi_1$ 131, the rotation angle about the $Y_1$-axis (body pitch angle) is $\theta_1$ 133, and the rotation angle about the $Z_1$-axis (body heading angle) is $\psi_1$ 135. Similarly, in the blade coordinate system, the rotation angle about the $X_2$-axis (blade roll angle) is $\phi_2$ 161, the rotation angle about the $Y_2$-axis (blade pitch angle) is $\theta_2$ 163, and the rotation angle about the $Z_2$-axis (blade heading angle) is $\psi_2$ 165.

Figure 1B:
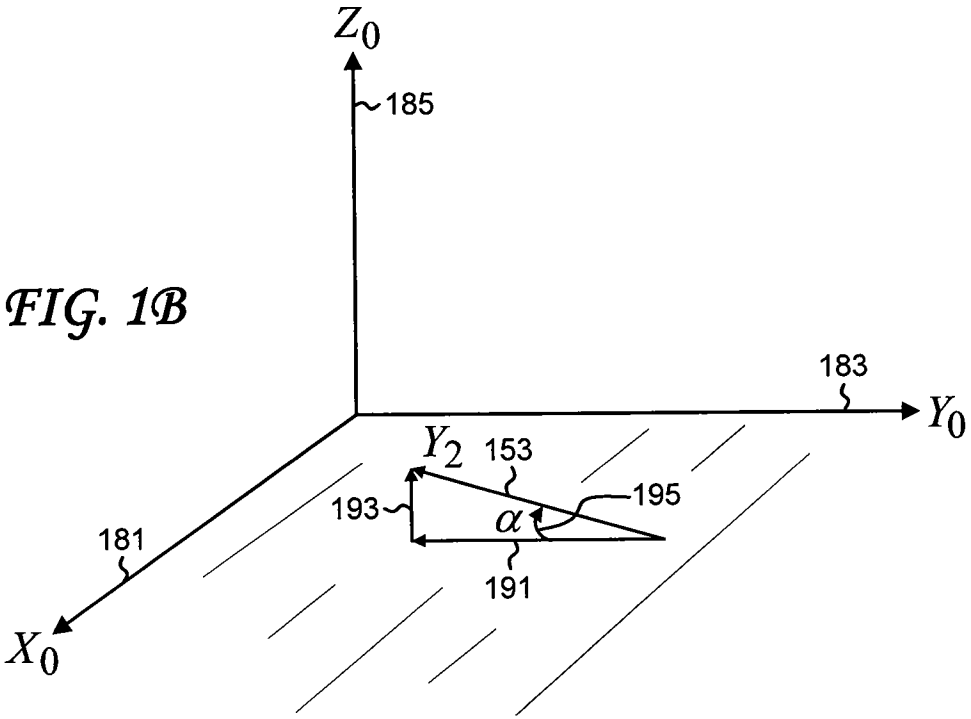
FIG. 1B shows a schematic of a reference frame fixed to the ground.

FIG. 1B shows a third coordinate system, fixed to the ground, specified by three orthogonal coordinate axes: the $X_0$-axis 181, the $Y_0$-axis 183, and the $Z_0$-axis 185. This coordinate system is sometimes referred to as a navigation coordinate system. The $X_0$-$Y_0$ plane serves as the local horizontal reference plane. The navigation coordinate system is typically specified by the site engineer. For example, the $X_0$-$Y_0$ plane can be tangent to the WGS 84 Earth ellipsoid.

Two blade parameters typically controlled during earth-moving operations are the blade elevation (also referred to as the blade height) and the blade slope angle. The blade elevation is the distance measured along the $Z_0$-axis between a reference point on the blade 104 and the $X_0$-$Y_0$ plane (or other reference plane parallel to the $X_0$-$Y_0$ plane). The blade slope angle is shown in FIG. 1B. The $Y_2$-axis 153 of the blade coordinate system is decomposed into a component 193 orthogonal to the $X_0$-$Y_0$ plane and a component 191 projected onto the $X_0$-$Y_0$ plane. The blade slope angle $\alpha$195 is the angle between the component 191 and the $Y_2$-axis 153.

Coordinates and angles specified in one reference frame can be transformed into coordinates and angles specified in another reference frame through well-known techniques, such as Euler angles or quaternions. For example, if the blade coordinate system is generated from the navigation coordinate system through the Euler angles (roll angle $\phi_2$ and pitch angle $\theta_2$), then the blade slope angle $\alpha$ is given by $$\alpha = \operatorname{atan}\left(\frac{\sin(\phi_2)\cos(\theta_2)}{\sqrt{\cos^2(\phi_2) + \sin^2(\phi_2)\sin^2(\theta_2)}}\right).$$

Translations along coordinate axes and rotations about coordinate axes can be determined from measurements by various sensors. In an embodiment, two inertial measurement units (IMUs) are mounted on the dozer 100. Each IMU includes three orthogonally-mounted accelerometers and three orthogonally-mounted gyros. Depending on the degrees of freedom of the blade, an IMU can include fewer accelerometers and gyros; for example, one accelerometer and one gyro. Each accelerometer measures the acceleration along a coordinate axis, and each gyro measures the angular rate (time derivative of rotation angle) about a coordinate axis. In FIG. 1A, the IMU 120, fixed to the dozer body 102, measures the accelerations along the ($X_1$, $Y_1$, $Z_1$)-axes and the angular rates about the ($X_1$, $Y_1$, $Z_1$)-axes. Similarly, the IMU 150, fixed to the back of the blade 104, measures the accelerations along the ($X_2$, $Y_2$, $Z_2$)-axes and the angular rates about the ($X_2$, $Y_2$, $Z_2$)-axes. Control systems based on IMUs have been described in PCT International Publication No. WO 2013/11940 ("Estimation of the Relative Attitude and Position between a Vehicle Body and an Implement Operably Coupled to the Vehicle Body") and U.S. Patent Application Publication No. 2010/0299031 ("Semiautomatic Control of Earthmoving Machine Based on Attitude Measurement"), both of which are incorporated by reference herein. Other embodiments use a single IMU or more than two IMUs.

Herein, when geometrical conditions are specified, the geometrical conditions are satisfied within specified tolerances depending on available manufacturing tolerances and acceptable accuracy; ideal mathematical conditions are not implied. For example, two axes are orthogonal if the angle between them is 90 deg within a specified tolerance; two axes are parallel if the angle between them is 0 deg within a specified tolerance; two lengths are equal if they are equal within a specified tolerance; and a straight line segment is a straight line segment if it is a straight line segment within a specified tolerance. Tolerances can be specified, for example, by a control engineer.

Other sensors can also be mounted on the dozer body or blade. For example, in FIG. 1A, a Global Navigation Satellite System (GNSS) sensor 140 is mounted on the roof 108 of the dozer cab 106. The GNSS sensor 140, for example, is an antenna electrically connected via a cable to a GNSS receiver (not shown) housed within the dozer cab 106. In some installations, the GNSS receiver is also mounted on the roof. The GNSS sensor 140 can be used to measure the absolute roof position in the WGS 84 coordinate system. The absolute blade position in the WGS 84 coordinate system can then be calculated from the absolute roof position and the relative position of the blade with respect to the roof based on measurements from the IMU 120 and the IMU 150 and based on known geometrical parameters of the dozer. In other configurations, the absolute position of the blade can be determined by a GNSS sensor (not shown) mounted on a mast fixed to the blade, as described in U.S. Patent Application Publication No. 2009/0069987 ("Automatic Blade Control System with Integrated Global Navigation Satellite System and Inertial Sensors"), which is incorporated by reference herein. When the GNSS sensor is mounted on the blade, the GNSS receiver can be installed either on the dozer body (for example, in the dozer cab) or on the blade.

Figure 2A:
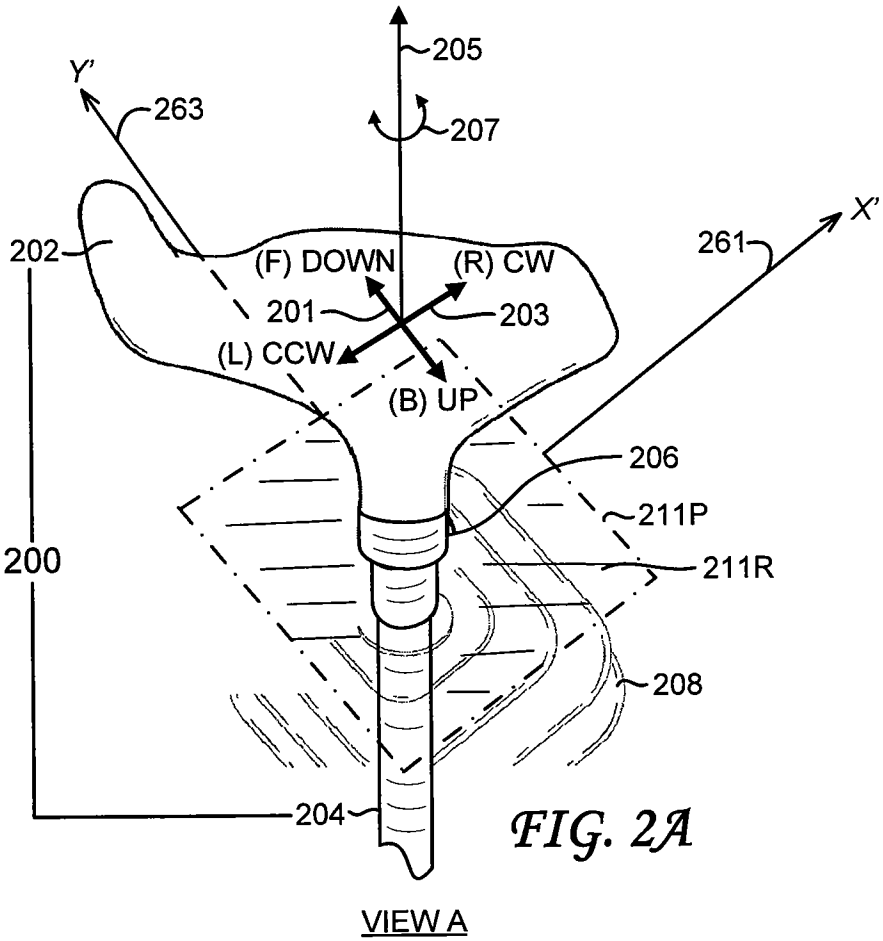
FIG. 2A shows a pictorial view of a joystick.

The dozer operator (not shown) sits on the operator's chair 110 within the dozer cab 106. FIG. 2A shows a pictorial view (View A) of a manual joystick for controlling the position and the orientation of the blade 104. The joystick 200 includes a joystick handle (joystick grip) 202 coupled to a joystick rod (joystick shaft) 204; also shown in FIG. 2A is a protective boot 208. In some designs, the joystick handle 202 is coupled to the joystick rod 204 via a clamp 206, and the joystick handle 202 can be detached from the joystick rod 204 by loosening the clamp 206. In other designs, the joystick handle 202 is permanently mounted to the joystick rod 204 and cannot be detached. Embodiments of the invention described below can accommodate both joysticks with handles that can be detached and joysticks with handles that cannot be detached.

Movement of the joystick 200 controls the hydraulic valves that control the hydraulic cylinders. As discussed above, the hydraulic valves can be mechanical valves or electric valves. A more detailed discussion of hydraulic control is provided below. The number of degrees of freedom of the joystick depends on the number of degrees of freedom of the blade. In some dozers, a blade can have a single degree of freedom (blade elevation). A 4-way blade has two degrees of freedom (blade elevation and blade slope angle). A 6-way blade has three degrees of freedom (blade elevation, blade slope angle, and blade heading angle).

Typical movement of a joystick for a 4-way blade is shown in FIG. 2A. The joystick 200 can be translated along the axis 201 and along the axis 203. From the perspective of the operator, the joystick 200 is translated forward (F)/backward (B) along the axis 201 and left (L)/right (R) along the axis 203. The axis 201 and the axes 203 are orthogonal. As discussed below, embodiments of the invention are not limited to translation axes that are orthogonal. The forward/backward translation of the joystick 200 is mapped to the down/up change in the blade elevation, and the left/right translation of the joystick 200 is mapped to the counterclockwise (CCW)/clockwise (CW) change in the blade slope angle. For a 6-way blade, the joystick 200, in addition to forward/backward translation and left/right translation, can be rotated about the central (longitudinal) axis 205 of the joystick through a rotation angle 207. Rotation of the joystick 200 about the central axis 205 is mapped to rotation of the blade about the blade's vertical axis.

The mapping described above between the translation and the rotation of the joystick and the translation and the rotation of the blade is one option. In general, other mappings between the translation and the rotation of the joystick and the translation and the rotation of the blade can be used.

For manual blade control, an operator grips the handle 202 with his hand and continuously moves the joystick forward/backward and left/right. Rotation about the central axis 205 is used typically only at the beginning of the current swath. The operator sets the desired push-off angle to move ground to the side from the swath. In general, movement of the joystick is not restricted to sequential translations along the axis 201 and the axis 203; for example, the joystick can be moved diagonally to change the blade elevation and the blade slope angle simultaneously. The joystick is returned back to the vertical position by an internal spring (not shown) with a reflexive (resistive) force of about 2 to 3 kg. The vertical position typically corresponds to no change in the blade elevation and no change in the blade slope angle.

The geometry described above is that viewed from the perspective of the operator. A more detailed description of the operational geometry of the joystick is shown in the schematic diagrams of FIG. 2B-FIG. 2E.

FIG. 2B shows a perspective view (View B). Shown is a Cartesian coordinate system defined by the X-axis 251, the Y-axis 253, the Z-axis 255, and the origin O 257. Shown are various reference points along the joystick rod 204. The reference point 204P is placed at the origin O. The reference point 204R is placed at a radius R 271 from the reference point 204P. In operation, the joystick rod 204 pivots about the reference point 204P. The reference point 204R therefore moves along a portion of the surface of the sphere 250. The portion of the surface of the sphere 250 that can be traced out by the reference point 204R is shown as the surface 252.

For mechanical valves, the joystick rod 204 can be coupled to a Cardan joint, and the reference point 204E (marking the end of the joystick rod 204) is placed on the Cardan joint. A mechanical assembly links the Cardan joint to the hydraulic valves. Movement of the joystick controls the hydraulic valves via the Cardan joint and the mechanical assembly. For electric valves, the joystick rod 204 can be coupled to potentiometers, and the reference point 204E is placed on a coupling assembly. Movement of the joystick controls the settings of the potentiometers, which in turn controls the current or voltage to the electric valves.

Also shown in FIG. 2B is a second Cartesian coordinate system, defined by the X'-axis 261, the Y'-axis 263, the Z' axis 265, and the origin O'267. The Z'-axis is coincident with the Z-axis, the X'-Y' plane is parallel to the X-Y plane, and the origin O' is displaced from the origin O by the height h 273.

FIG. 2C shows an orthogonal projection view (View C) sighted along the (−Z, −Z')-axis onto the X'-Y' plane. The projection of the surface 252 (FIG. 2B) is shown as the region 211R bounded by the perimeter 211P. In the example shown, the region 211R is a square. In general, the region 211R can have various geometries.

The X'-Y' plane, the region 211R, and the perimeter 211P is also shown in FIG. 2A. In an embodiment, the region 211R of the translation (also referred to as displacement or stroke) of the joystick has an approximately square shape with a size of about 60×60 mm (referenced at approximately the level of the clamp 206). In general, the joystick can be moved directly from a first point in the region 211R to a second point in the region 211R.

FIG. 2D shows a cross-sectional view (View D). The plane of the figure is the X-Z plane. In this example, the reference point 204R traces the arc 252D. Note that the height of the reference point 204R above the X'-axis can vary from 0 to Δh 275 (measured along the Z-axis).

FIG. 2E shows a second cross-sectional view (View E). The plane of the figure is the Y-Z plane. In this example, the reference point 204R traces the arc 252E. Note that the height of the reference point 204R above the Y'-axis can vary from 0 to Δh 275 (measured along the Z-axis).

U.S. Patent Application Publication No. 2013/0261902 ("Automatic Control of a Joystick for Dozer Blade Control"), which is incorporated herein by reference, describes automatic blade control with an electrical actuator unit coupled to the joystick. In an embodiment of the invention described herein, semi-automatic blade control is implemented with an electrical actuator unit coupled to the joystick 200. Translation of the joystick along a first axis (corresponding to control of a first degree of freedom) is automatically controlled, and translation of the joystick along a second axis (corresponding to control of a second degree of freedom) is manually controlled.

In some applications, control of the first degree of freedom is more dynamic (that is, requires more frequent corrections) than control of the second degree of freedom. For example, typically, control of the blade elevation is more dynamic than control of the blade slope angle. Refer to FIG. 2A. In this instance, translation of the joystick 200 along the Y' axis 263 is automatically controlled to control the blade elevation, and translation of the joystick 200 along the X'-axis 261 is manually controlled to control the blade slope angle. An electrical actuator unit providing automatic control of a single degree of freedom, as described herein, can be substantially less complex and less expensive than an electrical actuator unit providing automatic control of two degrees of freedom, as described in U.S. Patent Application Publication No. 2013/0261902.

Figure 3A:
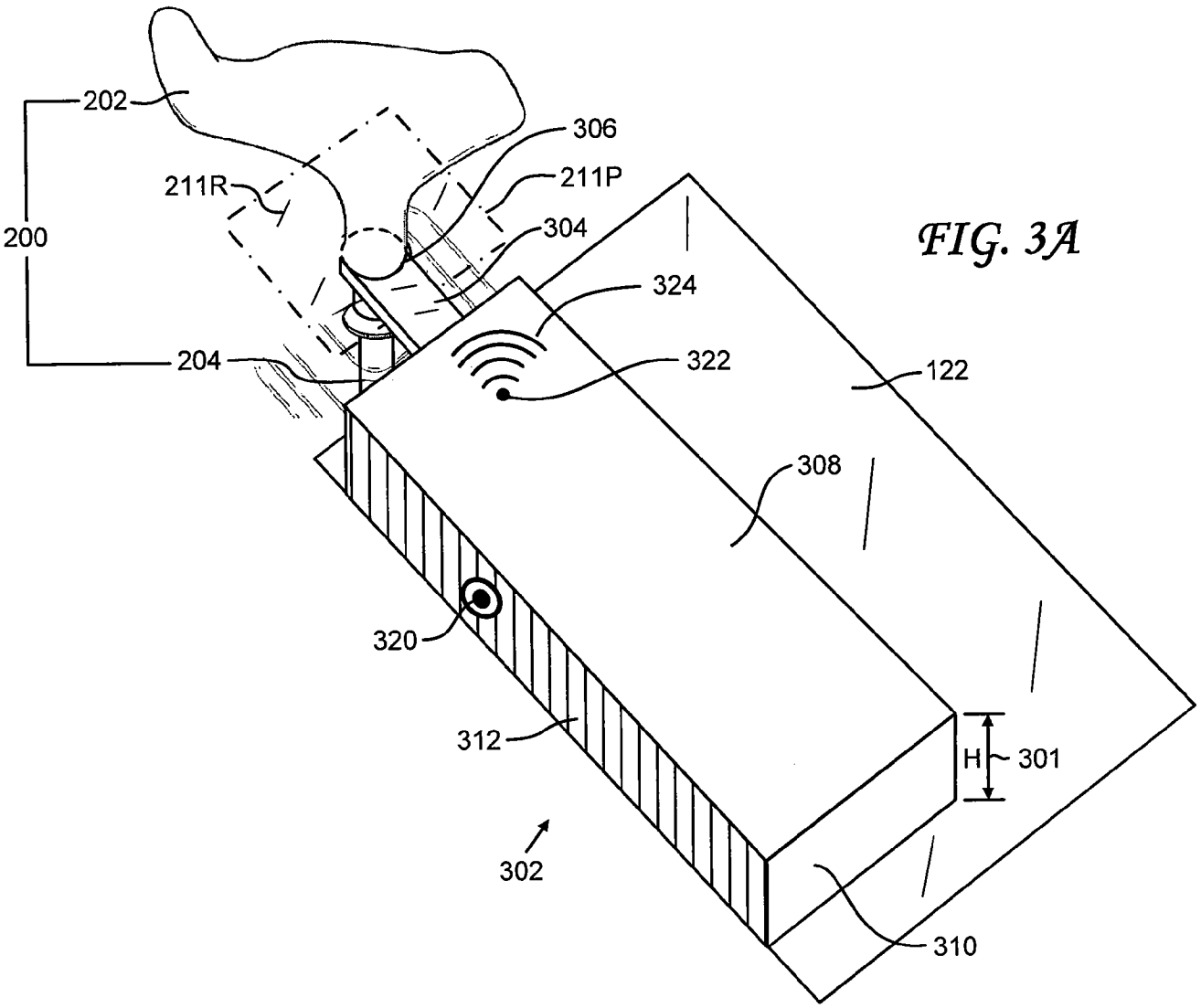
FIG. 3A-FIG. 3C show schematics of an electrical actuator unit operably coupled to a joystick.

Refer to FIG. 3A. The electrical actuator unit 302 has a motor-driven mechanical linkage 304 that is flexibly coupled to the joystick 200 via a coupling 306, which is positioned near the clamp 206 (FIG. 2A). The coupling 306 permits the electrical actuator unit 302 to be readily attached to and detached from the joystick 200. Details of the mechanical linkage 304, the coupling 306, and motor are described below.

Due to space constraints in the dozer cab 106 (FIG. 1A), the electrical actuator unit 302 is advantageously located in a specific region to maintain the convenience and comfort of the operator: in the area of the rear side of the joystick 200, as referenced from the viewpoint of the operator sitting in the operator's chair 110. This area is located over the top surface of the shelf 122. In typical dozers, the shelf 122 is installed at a standard height from the floor, and the right armrest (not shown) of the operator's chair 110 is mounted on the side of the shelf 122. The height of the armrest above the top surface of the shelf 122 is adjustable over a suitable range for the comfort of the operator. As described in more detail below, in some embodiments, the electrical actuator unit 302 can be mounted onto the armrest; in other embodiments, the armrest can be removed, and the electrical actuator unit can be mounted on the shelf 122.

Return to FIG. 3A. The motor and control electronics, described below, of the electrical actuator unit 302 are housed in a case 310. For simplicity, the case 310 is represented as a rectangular prism. The specific geometry and dimensions of the case 310 can be customized for specific installations. An important parameter is the height H 301 of the case 310. To maintain operator comfort and convenience while controlling the joystick 200 in the manual mode, the height H should have a maximum value determined by the maximum height of the armrest. A typical value of height H is about 100 mm.

In an embodiment, the top surface of the case 310 is covered with a soft mat 308, which can then serve as an armrest. The standard armrest can be removed if necessary, and the case 310 can be rigidly mounted to the shelf 122. The case 310 can also be installed with an angle bracket attached to the mounting holes used for mounting the armrest, once the armrest has been removed. In another embodiment, the armrest is not removed, but lowered in position. The case 310 is then mounted onto the top surface of the armrest with worm-gear hose clamps and directional brackets. Depending on the specific configuration of the dozer cab, various methods can be customized for installing the case 310 in the appropriate operational position.

The electrical actuator unit 302 has one active degree of freedom and two or more passive degrees of freedom. An active degree of freedom refers to a degree of freedom that moves the blade and consumes energy (such as electrical energy), and a passive degree of freedom refers to a degree of freedom that does not move the blade, but allows proper positioning, proper coupling, and manual operation of the joystick. In practice, an active degree of freedom should allow movement of the joystick 200 with millimeter accuracy to provide accurate control of the velocity of the hydraulic cylinders. In general, the number of passive degrees of freedom can be specified according to the number of degrees of freedom of the blade and according to the design and operation of the joystick.

In the automatic control mode of the electrical actuator unit, the mechanical linkage 304 moves the joystick 200 along one translation axis. The electrical actuator unit 302, for example, has one active degree of freedom to override the spring reflexive force and to translate the joystick 200 along the Y' axis 263 (FIG. 2A and FIG. 2C). The electrical actuator unit 302 also has a passive degree of freedom to permit manual translation along the X-axis 261 and to permit translation of the joystick 200 over the region 211R [the reference point 204R (FIG. 2B) is placed near the position of the clamp 206 (FIG. 2A)].

As discussed above, the joystick pivots about a pivot point; consequently, the absolute height of the clamp 206 varies as a function of joystick displacement (see FIG. 2D and FIG. 2E). Therefore, the electrical actuator unit 302 should have a passive degree of freedom to track changes in clamp height. In addition, for a 6-way blade, the electrical actuator unit 302 should also have a passive degree of freedom to allow the operator to manually rotate the joystick 200 about its central axis 205 (FIG. 2A). In one embodiment, therefore, the electrical actuator unit 302 has in total four degrees of freedom: one active degree and three passive degrees.

Even with the electrical actuator unit installed, however, it is necessary to allow blade operation in manual mode: when the electrical actuator unit is turned off, it should provide a minimum resistance to joystick movement by the operator's hand. A worm gear or a gear with a large conversion ratio, therefore, is not suitable to be used in the electrical actuator unit; a direct drive motor is advantageous for this task. Details of a suitable motor assembly are discussed below.

Return to FIG. 3A. To allow the operator to choose an operating mode [automatic (auto) or manual (man)] of the electrical actuator unit 302, there is an auto/man switch 320. Various types of switches can be used; a push-button switch is shown as an example. In the automatic mode, translation of the joystick 200 along the Y'-axis is automatically controlled by the electrical actuator unit 302 (for example, to control the blade elevation). In the manual mode, translation of the joystick 200 along the Y'-axis is manually controlled by the operator. The switch 320 can be located in various positions. In the embodiment shown in FIG. 3A, the switch 320 is positioned on the side face 312 of the case 310. The switch 320 can also be positioned away from the case 310; for example, on the shelf 122.

Translation of the joystick 200 along the X'-axis is manually controlled (for example, to control the blade slope angle) regardless of whether translation of the joystick 200 along the Y' axis is automatically or manually controlled. Therefore, when the electrical actuator unit 302 is switched to the automatic mode, overall control of the joystick 200 is in the semi-automatic mode; and when the electrical actuator unit 302 is switched to the manual mode, overall control of the joystick 200 is in the manual mode.

In the automatic mode, the electrical actuator unit 302 translates the joystick 200 along the Y'-axis. When the operator needs to translate the joystick 200 along the X'-axis, he needs to grip the joystick. Since it is difficult to grip the joystick while it is moving fast, the automatic mode should be disengaged when manual operation of the joystick is required. Although the switch 320 can be used to switch the mode from auto to man, the operator must remember to promptly press the switch prior to gripping the joystick. The switching operation also increases response time. Furthermore, as discussed below, in some applications, total disengagement of the automatic mode is not desired.

In an embodiment, a proximity sensor detects when the operator is about to grip the joystick and disengages the auto mode (either totally or partially; see discussion below) before the operator's hand grips the joystick. Various proximity sensors can be used, including inductive, capacitive, thermal infrared, video, radio, sonic radar, and optical radar sensors. Key design parameters for the proximity sensor are the detection range and the directional pattern. The detection range is the range of distances from the proximity sensor over which a target is detected. The directional pattern is the angular range over which a target is detected; for some proximity sensors, the directional pattern approximately corresponds to the field of view. In practice, the detection range should be adjustable from a few centimeters to tens of centimeters. The directional pattern should be narrow enough to prevent false detections.

The proximity sensor can be mounted separately from the electrical actuator unit or mounted on the electrical actuator unit. Refer to FIG. 3A. In an advantageous embodiment, the proximity sensor 322 is mounted on the top surface of the case 310. The proximity sensor 322 operates according to the optical radar principle. An optical transmitter transmits an optical signal to the target, which reflects the optical signal back towards the optical transmitter. An optical detector detects the return optical signal. From the time of flight between transmission of the optical signal and detection of the return signal, the proximity sensor can calculate the distance between the proximity sensor and the target. In FIG. 3A, the transmitted optical signal 324 is represented by a series of arcs (the optical signal is transmitted up from the top surface of the case 310). The proximity sensor 324 can reliably detect the presence of at least a portion of a hand, wrist, or forearm while avoiding false detections caused by dust or the moving joystick.

Figure 3B:
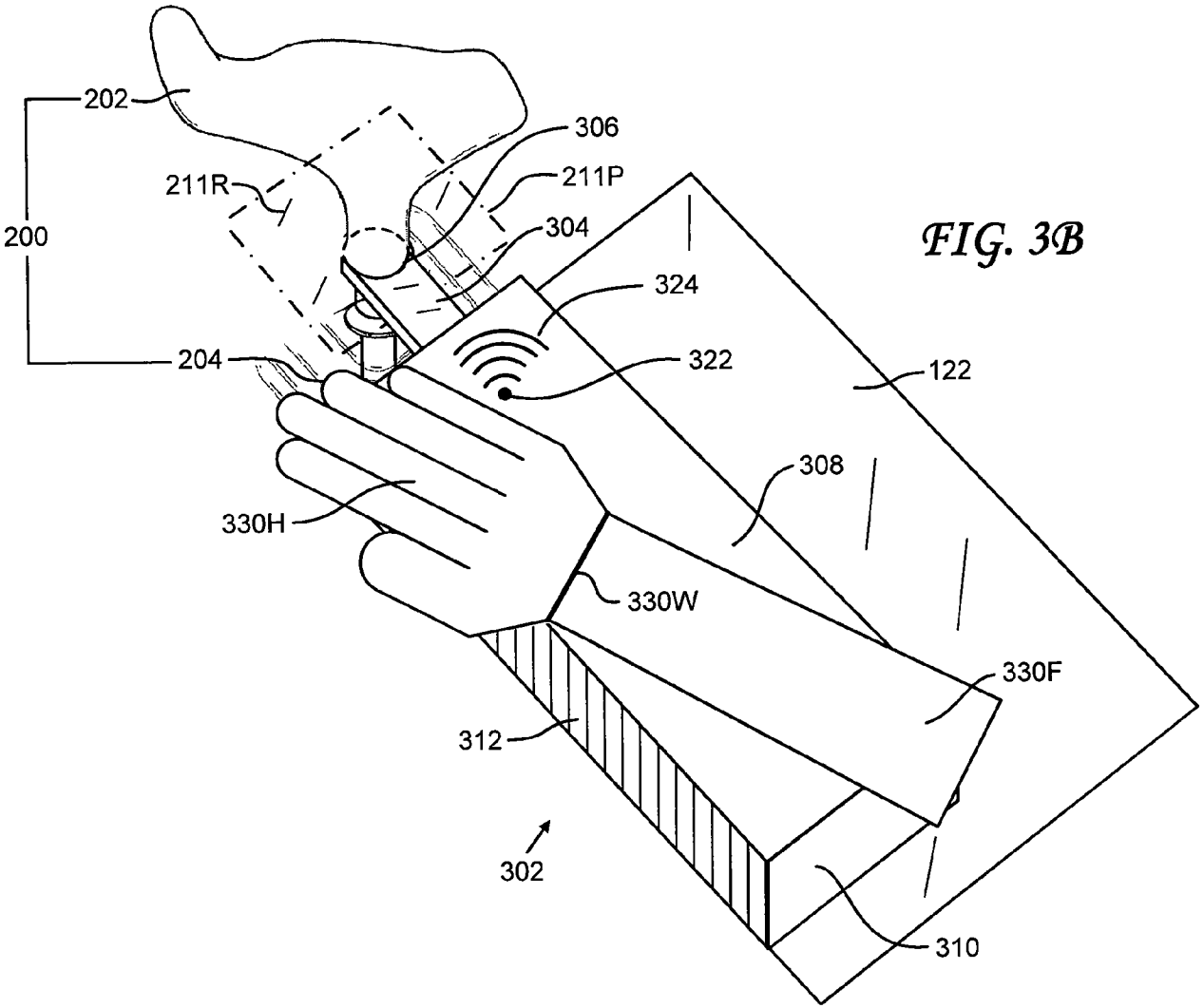

Refer to FIG. 3B. Shown are the operator's hand 330H, wrist 330W, and forearm 330F in the at-rest position. As mentioned above, for simplicity, the case 310 is represented by a rectangular prism; in practice, the case 310 can be contoured or sculpted for operator comfort. The proximity sensor 322 is uncovered. The switch 320 has activated the auto mode; and the electrical actuator unit 302 is actively translating the joystick 200 along the Y' axis to control the blade elevation.

Figure 3C:
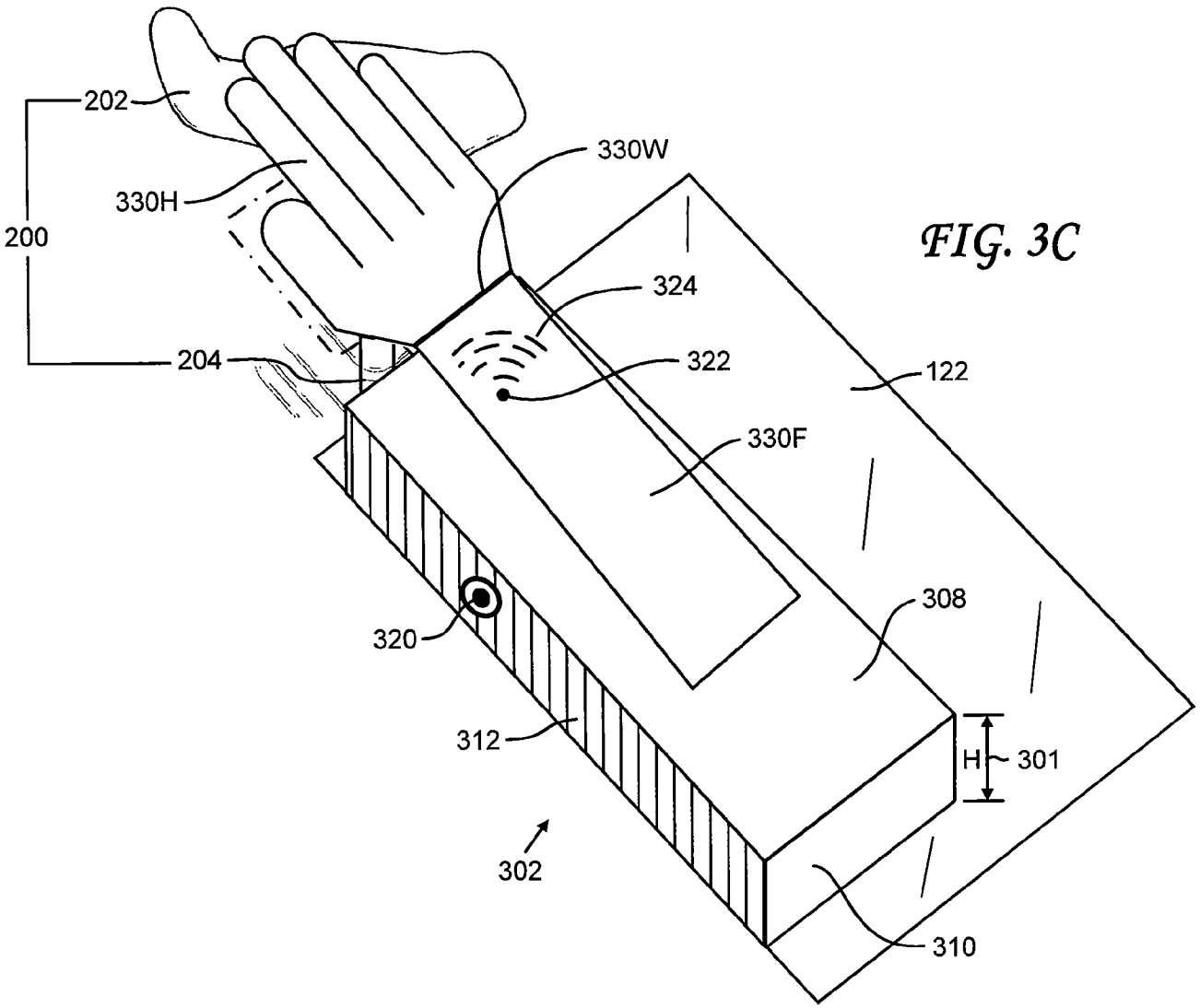

Refer to FIG. 3C. When the operator needs to manually control the joystick (for example, to manually control the blade slope angle, the blade heading angle, or the blade elevation), he reaches for the joystick. As the operator reaches for the joystick, at least a portion of his hand, wrist, or forearm is poised above the proximity sensor 322, which detects the presence of at least a portion of the hand, wrist, or forearm and disengages the auto mode before the operator grips the joystick and while the operator is gripping the joystick. Details of how the proximity sensor disengages the auto mode are described below. After the operator has finished manual operation of the joystick, the operator returns his hand, wrist, and forearm to the at-rest position shown in FIG. 3B. The proximity sensor is again uncovered, and the auto mode is re-engaged.

Additionally, for safe operation, the electrical actuator unit 302 supports operator reflex override intervention to take the system under full human control in a critical situation, without the need to depend on the switch 320 or the proximity sensor 322. When the electrical actuator unit is operating in the auto mode, the operator can override the auto control simply by gripping the joystick and moving it. In embodiments in which triggering the proximity sensor causes partial disengagement (see discussion below) of the auto mode of the electrical actuator unit, manual intervention overrides the auto control and moves the blade as needed in specific instances. In an embodiment, the electrical actuator unit 302 continuously monitors drive current to the motor and turns off power in the event of an overcurrent condition resulting from manual override of the joystick (see further details below). In embodiments in which triggering the proximity sensor causes total disengagement of the auto mode of the electrical actuator unit, monitoring the drive current provides redundancy; for example, extreme conditions (such as bright sun, heavy dust, and heavy moisture) may interfere with proper operation of the proximity sensor.

Figure 6A:
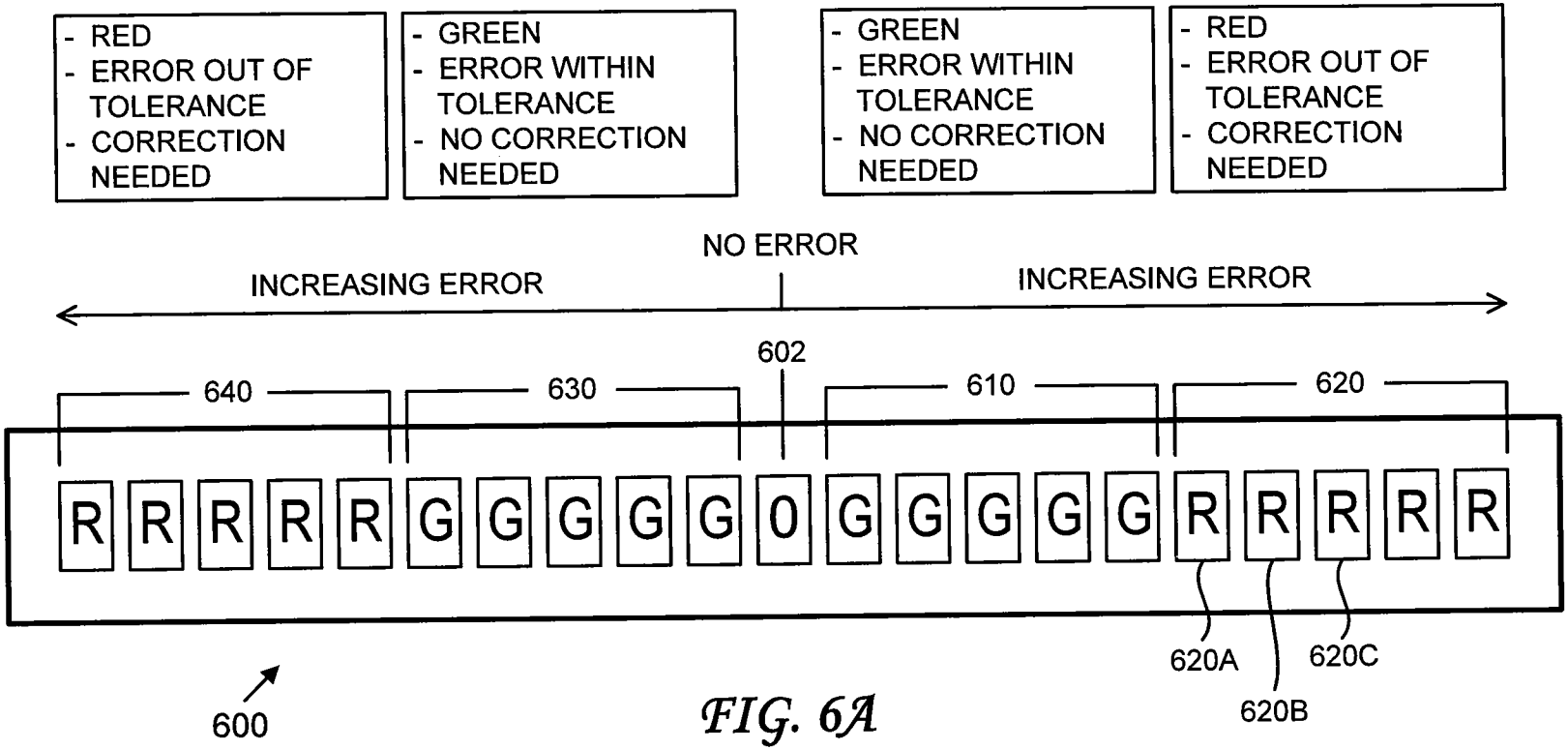
FIG. 6A and FIG. 6B show schematics of embodiments of indicator displays.

In an embodiment, for manual control of the blade slope angle, the operator is guided by an indicator display. The indicator display can be displayed on the video display 124 in the dozer cab 106 (FIG. 1A), or the indicator display can be a separate unit located in the dozer cab. FIG. 6A shows an embodiment of an indicator display, referenced as the indicator display 600. The indicator display 600 includes a horizontal linear array of light-emitting diodes (LEDs). The center white LED (marked 0) is referenced as LED-0 602. To the right of the LED-0 602 are the segment 610 of green LEDs (marked G) and the segment 620 of red LEDs (marked R). Similarly, to the left of the LED-0 602 are the segment 630 of green LEDs and the segment 640 of red LEDs. The specific colors of the LEDs are a design choice. In this example, each segment includes five LEDs; in general, the number of LEDs in each segment is a design choice.

The indicator display 600 receives a control signal from a computational system (as described below in reference to FIG. 4A). The control signal is a function of the difference between the estimated value (calculated from measurements) of the blade slope angle and the reference value (also called the target value) of the blade slope angle. The control signal is converted by a display driver to a display driver signal that activates a specific LED. The display driver can be a separate unit from the display or integrated with the display; to simplify the discussion, it is considered to be integrated with the display. If the LED-0 is lit, the estimated value of the blade slope angle is equal to the target value, there is no error, and no correction is needed at the particular moment (the operator continues to monitor the display for changes). If a green LED is lit, the estimated value of the blade slope angle is not equal to the target value; however, the error is within tolerance, and no correction is needed at the particular moment (the operator continues to monitor the display for changes). As the error between the estimated value and the target value increases, the specific lit green LED is further away from the LED-0. If a red LED is lit, the error between the estimated value and the target value exceeds the tolerance, and correction is needed at the particular moment. As the error between the estimated value and the target value increases, the specific lit red LED is further away from the LED-0.

If the operator sees a lit red LED, he must take corrective action. The position (left/right) of a green or red LED with respect to the LED-0 indicates the sign of the difference between the estimated value and the target value. The convention is a design choice; in one example, the segments to the right of the LED-0 indicate that the estimated value is greater than the target value, and the segments to the left of the LED-0 indicate that the estimated value is less than the target value. If the lit red LED is in the segment 620 (right of LED-0), the operator corrects by translating the joystick to the left (FIG. 2A). Similarly, if the lit red LED is in the segment 640 (left of LED-0), he corrects by translating the joystick to the right.

The specific lighting pattern representing the status of the estimated value of the blade slope angle is a design choice determined by a specific control algorithm. Different lighting patterns can more readily attract the attention of the operator; and different lighting patterns can more effectively deal with sun glare. Assume that the status can be indicated by the red LED 620C. In the example above, only a single LED (the red LED 620C) is lit. In a second example, all the LEDs from LED-0 602 to the red LED 620C (that is LED-0 602, all the green LEDs in the segment 610, the red LED 620A, the red LED 620B, and the red LED 620C) are lit to form an illuminated band. In a third example, the LED-0 602 is not lit, all the green LEDs in the segment 610 are lit but dimmed, and the red LED 620A, the red LED 620B, and the red LED 620C are lit and flashing.

Similar indicator displays can also be used to guide manual correction of other blade parameters, such as the blade elevation and the blade heading angle. For example, a vertical linear array of LEDs can be used to guide control of the blade elevation, and a circular array of LEDs can be used to guide control of the blade heading angle. Again, the indicator displays can be displayed on the video display 124, or the indicator displays can be separate units.

Figure 6B:
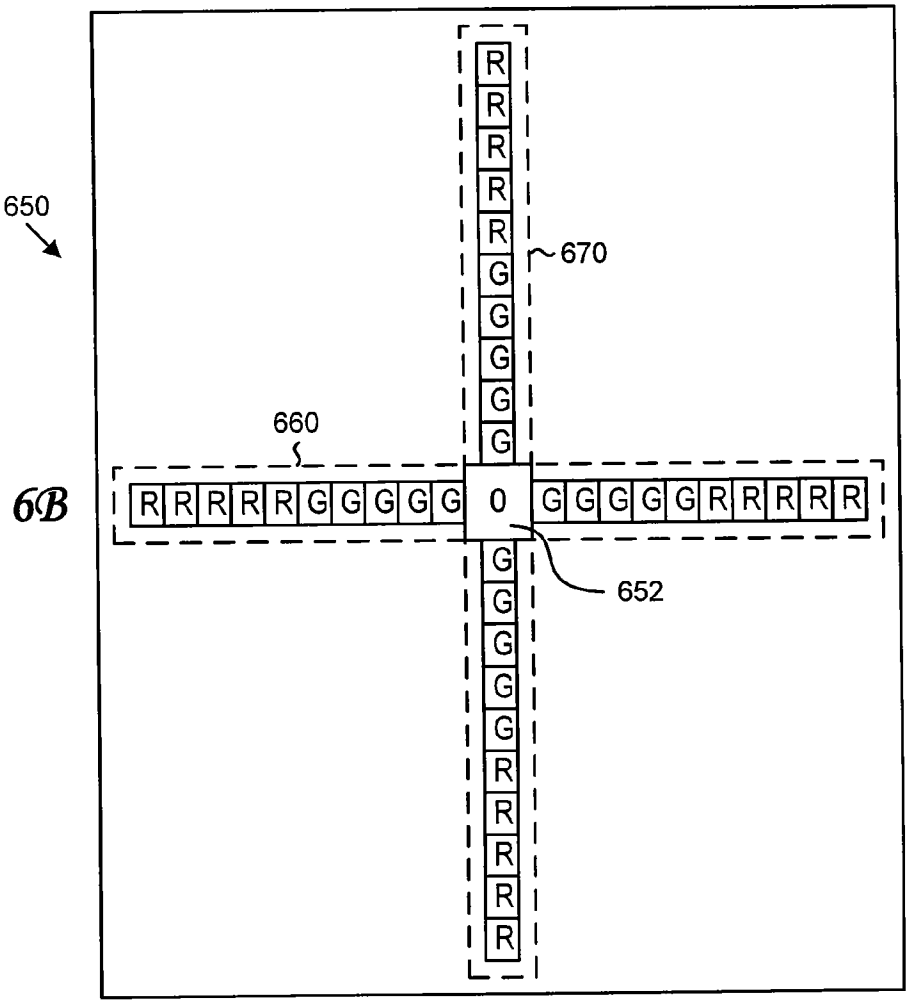

FIG. 6B shows an embodiment of an indicator display, referenced as the indicator display 650. The indicator display 650 includes the horizontal linear array of LEDs 660, which displays the status of the blade slope angle, and the vertical linear array of LEDs 670, which displays the status of the blade elevation. The central LED, LED-0 652, indicates no error in either the blade elevation or the blade slope angle. A control signal from a computational system controls (via a display driver) the specific LED to be lit in the horizontal linear array of LEDs 660 and the specific LED to be lit in the vertical linear array of LEDs 670. The vertical linear array of LEDs 670 can be used when the operator has decided to manually override automatic control of the blade elevation. The vertical linear array of LEDs can also alert the operator in the event that the operator has neglected to return to automatic control of the blade elevation and the blade elevation has drifted out of tolerance. The vertical linear array of LEDs can further provide a visual indication that the automatic control of the blade elevation is operating properly.

In some embodiments, for control of blade elevation, the vertical linear array of LEDs 670 is activated in the manual mode and deactivated in the automatic mode. In other embodiments, the vertical linear array of LEDs 670 is activated in both the manual mode and the automatic mode; a separate indicator can indicate whether the mode of the electrical actuator unit is auto or man. The specific lighting patterns representing the status of the estimated value of the blade slope angle and the status of the estimated value of the blade elevation are design choices determined by specific control algorithms (which can be different for each blade parameter).

In general, an indicator display can provide graphical representations of differences between estimated values (calculated from measurements) and reference values of system parameters. In some embodiments, the system parameters are blade parameters (such as blade elevation, blade slope angle, and blade heading angle). In other embodiments, the system parameters are body parameters (such as body pitch angle and body roll angle) which are dependent on blade parameters (see, for example, US Patent Application Publication No. US 2010/0299031, previously cited).

Figure 4A:
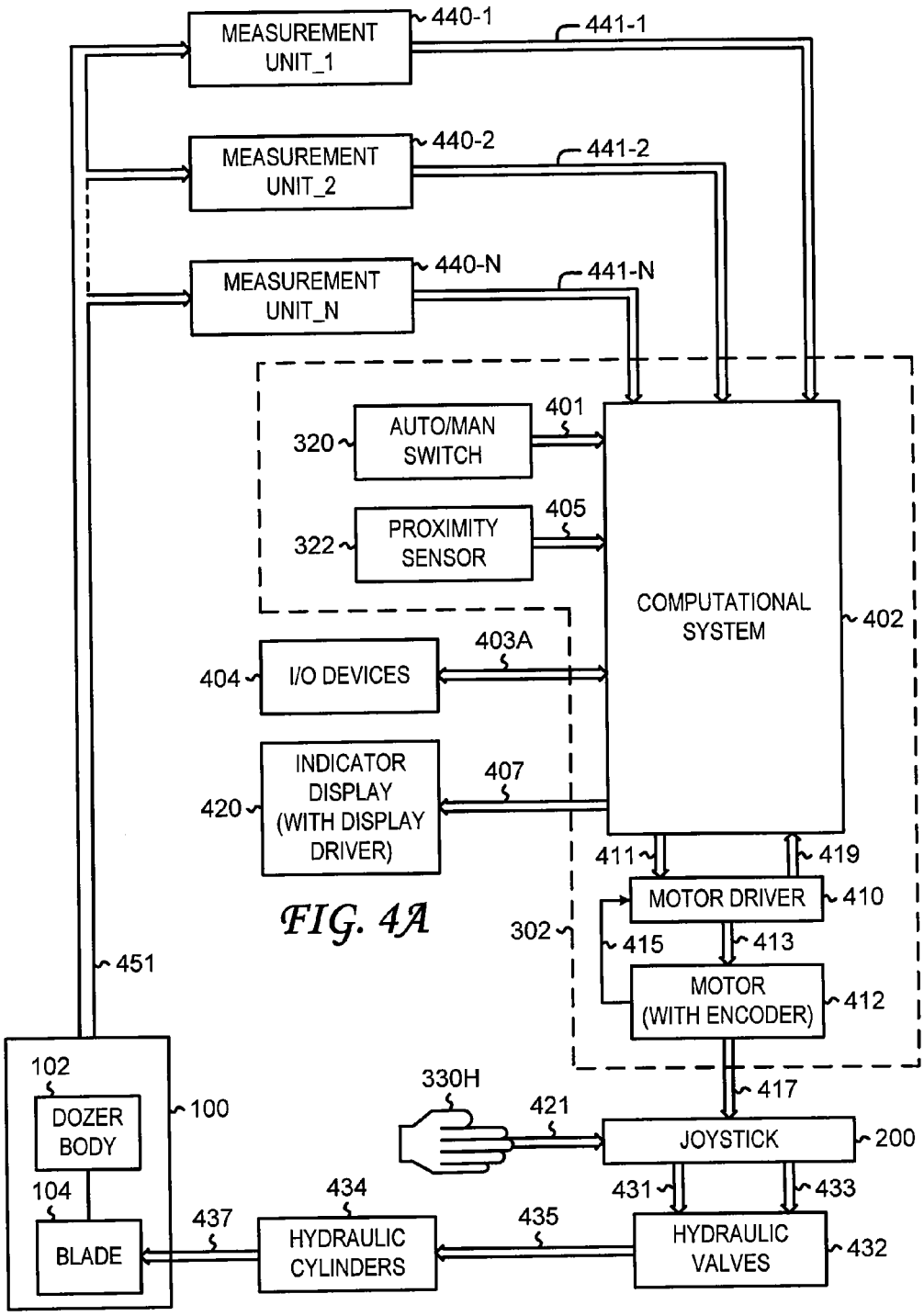
FIG. 4A-FIG. 4C show schematics of different embodiments of semi-automatic control systems.

FIG. 4A shows a schematic block diagram of an overall semi-automatic control system, according to an embodiment of the invention. The semi-automatic control system is a closed feedback system that corrects for dynamic and static impacts on the system and for measurement errors. Dynamic impact appears in the system from the outside world only during machine and blade movement, but static impact is present during any condition. Reaction force from the ground to change of body position is an example of dynamic impact, while blade weight is an example of static force (static impact).

The electrical actuator unit 302 includes the computational system 402, the auto/man switch 320, the proximity sensor 322, the motor driver 410, and the motor (with encoder) 412. The computational system 402 receives the switch state status signal 401 (auto/man) from the auto/man switch 320 and the proximity sensor object detection status signal 405 (object not detected/object detected) from the proximity sensor 322. Here the object corresponds to at least a portion of the operator's hand or wrist or forearm. The computational system 402 also receives the input 403A from the input/output (I/O) devices 404. The I/O devices 404 are discussed in more detail below; an example of an I/O device is a keypad or a touchscreen. The input 403A includes various information, such as a set of reference values that specify the reference (target) values of the position and the orientation of the blade (see further discussion below).

Sets of measurements are generated by one or more measurement units; a measurement unit includes one or more sensors and associated hardware, firmware, and software to process signals from the sensors and generate measurements in the form of digital data. The measurement units can be mounted on the dozer body 102 or the blade 104 (FIG. 1A). Specific examples of measurement units and specific placement of measurement units are discussed below. In general, there are N measurement units, where N is an integer greater than or equal to one. In FIG. 4A, the measurement units are referenced as measurement unit_1 440-1, measurement unit_2 440-2, . . . , measurement unit_N 440-N, which output measurements_1 441-1, measurements_2 441-2, . . . , measurements_N 441-N, respectively. In general, the components and configuration of each measurement unit and the set of measurements outputted by each measurement unit can be different. The computational system 402 receives the measurements from the measurement units.

Inputs 451 to the measurement units represent the position and orientation state of the dozer 100, including the position and orientation state of the dozer body 102, the blade 104, and other components (such as extensions of hydraulic cylinders). The dozer 100 and various components, including the hydraulic cylinders 434, the hydraulic valves 432, and the joystick 200 are subject to dynamic and static impacts. The measurements are also subject to measurement errors. Measurement errors can result from various causes, including the effect of electrical noise on certain sensors and the effects of temperature, shock, and vibration on certain sensors.

In the electrical actuator unit 302, the computational system 402 filters the sets of input measurements to compensate for measurement errors and calculates estimates (estimated values) of the position and orientation of the blade. Various filters, such as Kalman filters and extended Kalman filters, can be used to fuse the various sets of measurements. The filtering and calculation steps performed by the computational system 402 are specified by a control algorithm stored in the computational system 402. The control algorithm, for example, can be entered via the I/O devices 404 by a control engineer during installation of the semi-automatic control system. The control algorithm depends on the type, number, and placement of the measurement units installed and on the degrees of freedom to be controlled. Details of an embodiment of the computational system 402 are discussed below.

The computational system 402 then calculates error signals from the differences between the estimated values and the reference values (included in the input 403A). From the error signals, the computational system 402 calculates corresponding control signals according to the control algorithm.

Figure 8:
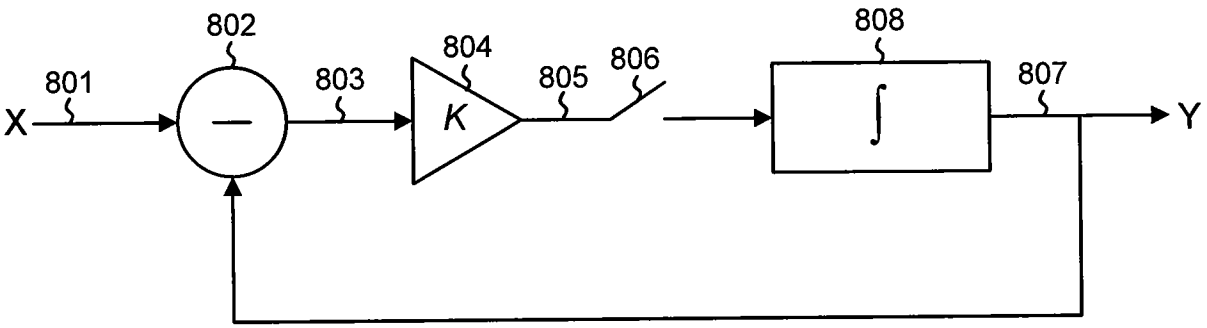
FIG. 8 shows a schematic of a control algorithm.

FIG. 8 shows a schematic of a basic control algorithm implementing a proportional (P) controller. The input signal X 801 is a reference signal which puts the system in the desired condition defined by the output signal Y 807. The subtraction unit 802 receives the input signal X and the output signal Y and calculates the difference X-Y. The difference signal 803 is then inputted into the amplifier 804, which multiplies the difference signal 803 by the gain factor K. The gain factor K is a tunable parameter; its value is specified based on the desired bandwidth of the system, measurement noise, dynamic and static impacts, and inherent gain factors of components inside the control loop.

The output signal 805 is inputted into the switch 806, which is open in the manual mode and closed in the automatic mode. In the automatic mode, the output signal 805 is inputted into the integrator 808. The output of the integrator 808 is the output signal Y 807. More complex control algorithms can be specified and entered into the computational system 402. Control algorithms are well-known in the art; further details are not described herein.

Return to FIG. 4A. In the automatic mode, the motor driver 410 receives the control signal 411 and generates the motor drive signal 413, which represents an electrical voltage or current that drives the motor 412. The motor driver 410 transmits the output signal 419, which represents the value of the motor drive signal 413, back to the computational system 402. The output signal 419, for example, can represent the value of the drive current in amps. The computational system 402 monitors the output signal 419 to determine an overdrive condition. For example, if the output signal 419 exceeds a specific threshold value, the computational system 402 can disable the automatic mode, and the electrical actuator unit 302 will revert to manual mode: the auto/man switch 320 will reset to manual mode; to return to automatic mode, the operator must depress the auto/man switch 320 again. The specific threshold value can be set, for example, by a control engineer during installation of the electrical actuator unit 302.

The motor 412 is outfitted with an encoder that estimates the position of the motor shaft and transmits a feedback signal 415 containing the position estimates back to the motor driver 410. If the motor is a stepper motor, an encoder is not needed; a reference home position of the shaft is stored, and the position of the shaft is determined by the number of steps from the home position.

A motor driver can be implemented by different means; for example, by a single integrated circuit or by a multi-component printed circuit board. A motor driver can be embedded into a motor. In general, the motor driver depends on the specific type of motor and specific type of encoder.

The motor controls the joystick stroke along a single translation axis. The joystick stroke unambiguously depends on the position of the motor shaft. Local feedback allows unambiguous conversion of digital code (in the control signal) to position, improves the response time of the electrical actuator, and compensates for negative effects from dynamic and static impacts. Efficient compensation can be applied for nonlinear dependency (include dead band) of the blade velocity versus joystick stroke for a particular combination of motor, hydraulic valves, and hydraulic cylinders. To achieve the desired compensation, a calibration procedure is run on the dozer after the electrical actuator has been installed.

The motor 412 can translate the mechanical linkage 304 (FIG. 3A), which, in turn, can translate the joystick 200. The motor 412 causes the translation 417 along the Y'-axis, for example, to control the elevation channel. The operator's hand 330H applied to the joystick 200 causes the translation 421 along the X'-axis to control the slope channel. Translation of the joystick 200 generates two outputs, referenced as output 431 and output 433. The output 431 and the output 433 change the position of the spools in the hydraulic valves 432; the changes in the positions of the spools in turn change the flow rate of the hydraulic fluid 435 that moves the hydraulic cylinders 434. For manual valves, the joystick 200 can be operably coupled to the valves via a mechanical linkage. For electric valves, the joystick 200 can be operably coupled to potentiometers or other electrical devices that control the voltage or current to the solenoids.

The hydraulic cylinders 434 exert forces 437 on the blade 104 and change the position and the orientation of the blade 104. The hydraulic cylinders 434 therefore change the configuration of the dozer 100: the mutual position and orientation of the blade 104 and the dozer body 102. The measurement units sense this change and provide information for further processing. The desired closed feedback loop is thus completed.

As discussed above, manual control of a blade parameter can be guided by an indicator display 420, which displays the status of the estimated value of the blade parameter; examples of the indicator display 420 include the indicator display 600 (FIG. 6A), the indicator display 650 (FIG. 6B), and the video display 124 (FIG. 1A). The computational system 402 calculates an error signal from the difference between the estimated value of a blade parameter and a reference (target) value of the blade parameter. From the error signal, the computational system 402 calculates a corresponding control signal 407 according to a control algorithm. The control signal 407 is received by the display driver in the indicator display 420, and the display driver generates a display drive signal which generates a graphical representation of the status of the blade parameter on the indicator display 420. As mentioned above, for simplicity, the display driver is shown integrated with the indicator display; in general, the display driver can be a separate unit. In general, the indicator display can display the status of one or more system parameters.

As discussed above, translation of the joystick typically controls two degrees of freedom of the implement operably coupled to the vehicle body; for example, the blade elevation and the blade slope angle. In some applications, the blade elevation and the blade slope angle are directly controlled. The computational system receives a reference value of the blade elevation and a reference value of the blade slope angle. From the received measurements, the computational system calculates an estimated value of the blade elevation and an estimated value of the blade slope angle. The computational system then calculates an error signal for control of the blade elevation (from the estimated value of the blade elevation and the reference value of the blade elevation) and calculates an error signal for control of the blade slope angle (from the estimated value of the blade slope angle and the reference value of the blade slope angle).

In other applications, however, there is a different method for controlling the blade elevation and the blade slope angle. In US Patent Application Publication No. US 2010/0299031, previously cited, for example, the (dozer) body pitch angle and the (dozer) body roll angle are controlled by controlling the blade elevation and the blade slope angle. The computational system receives a reference value of the body pitch angle and a reference value of the body roll angle. From the received measurements, the computational system calculates an estimated value of the body pitch angle and an estimated value of the body roll angle. Since the functional dependence of the body pitch angle and the body roll angle on the blade elevation and the blade slope angle are known for the moving machine, the computational system can calculate a corresponding estimated value of the blade elevation, a corresponding estimated value of the blade slope angle, a corresponding reference value of the blade elevation, and a corresponding reference value of the blade slope angle. The computational system then calculates an error signal for control of the blade elevation (from the estimated value of the blade elevation and the reference value of the blade elevation) and calculates an error signal for control of the blade slope angle (from the estimated value of the blade slope angle and the reference value of the blade slope angle).

In general, the computational system receives reference values of system parameters (which can be implement parameters, body parameters, or combinations of implement parameters and body parameters). From received measurements, the computational system calculates estimated values of system parameters. The functional relationships between the system parameters and the degrees of freedom controlled by the joystick are known. The computational system calculates corresponding estimated values of the degrees of freedom and corresponding reference values of the degrees of freedom. Note that the reference values (both the reference values of the system parameters and the reference values of the degrees of freedom) can be dynamically updated. The computational system then calculates error signals for controlling the degrees of freedom (via translations of the joystick).

Figure 4B:
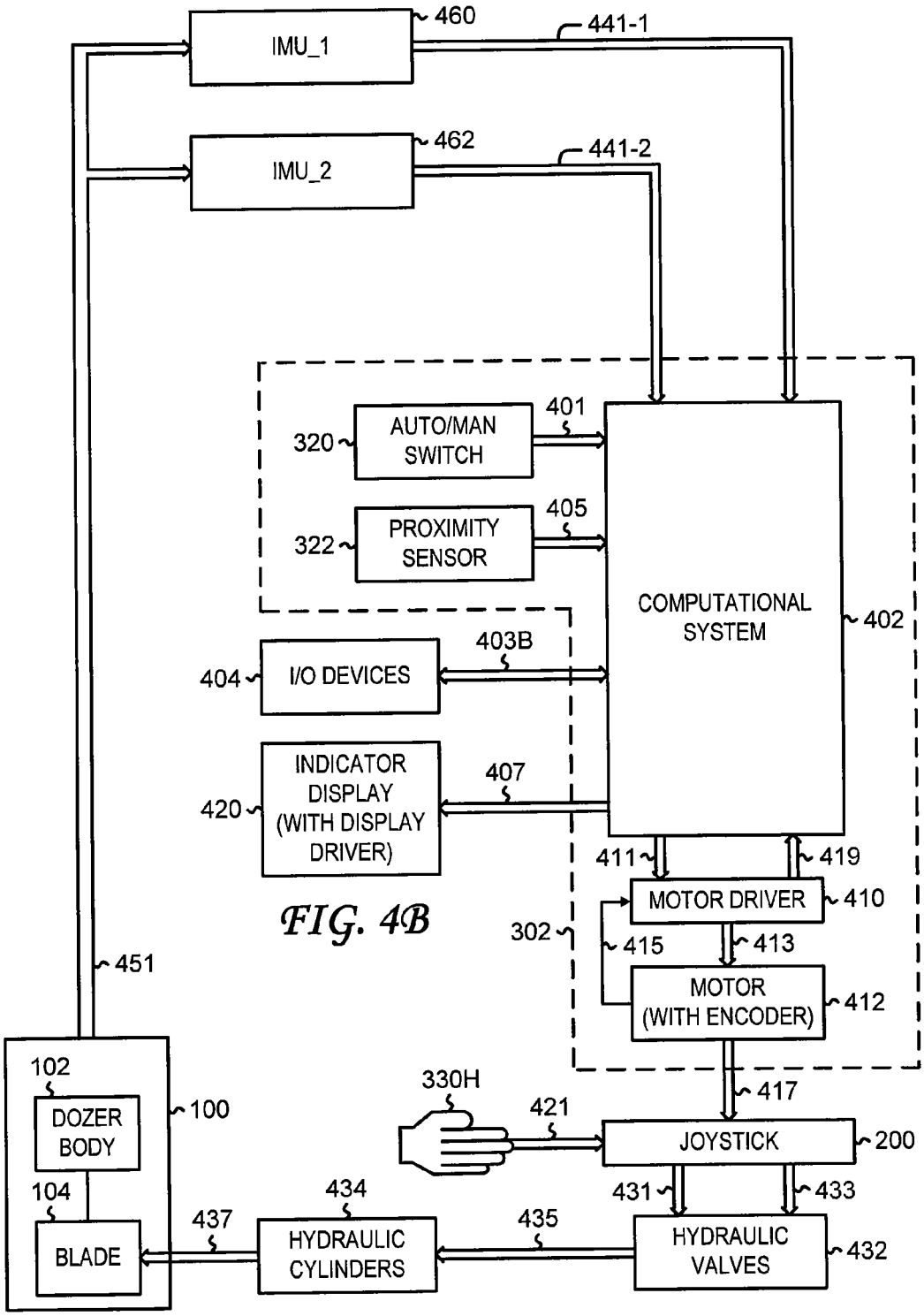
Figure 4C:
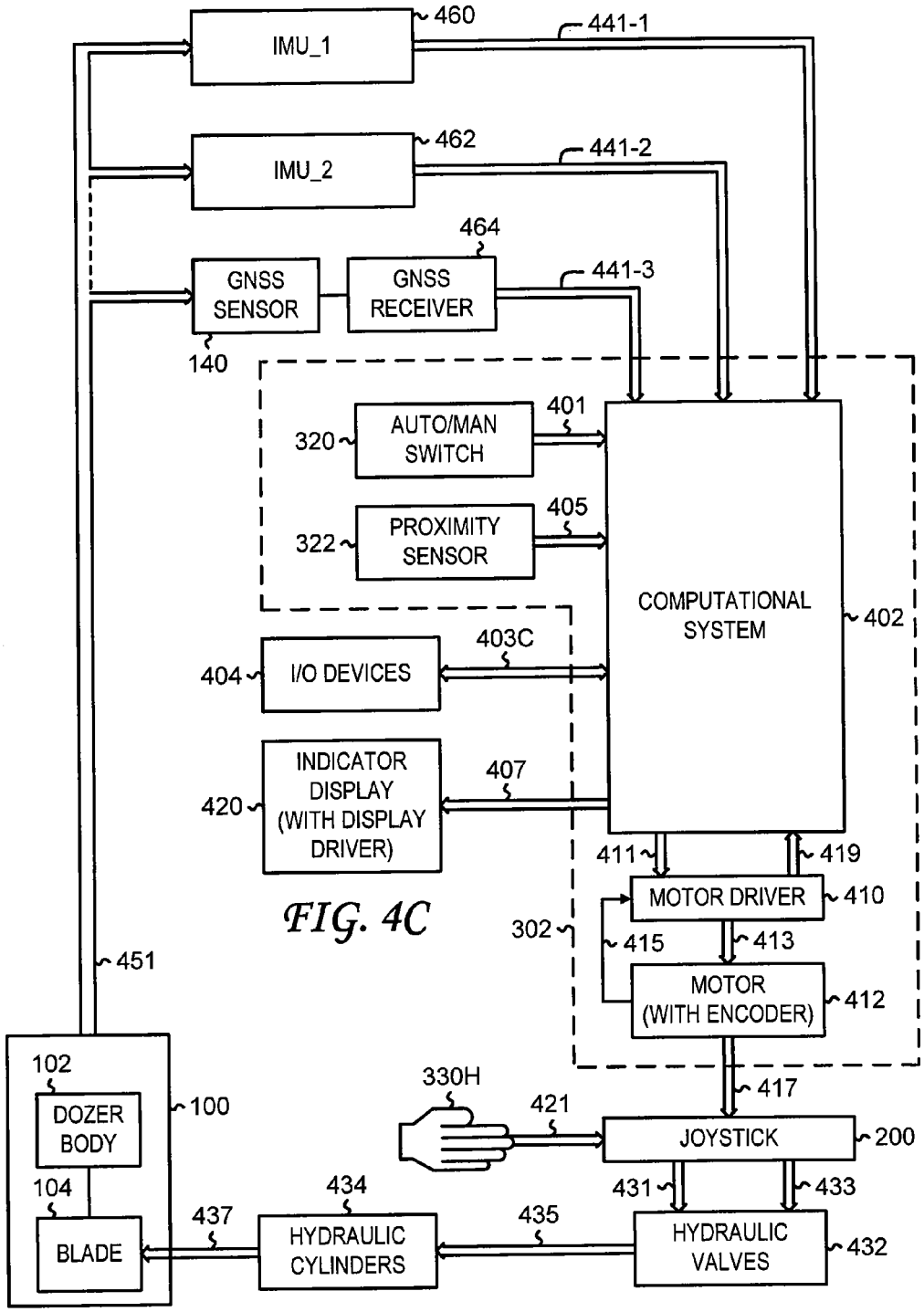

FIG. 4B and FIG. 4C show embodiments of semi-automatic control systems with particular types and configurations of measurement units.

FIG. 4B shows a schematic block diagram of an embodiment of a semi-automatic control system with two inertial measurement units (IMUs). In this embodiment, the first IMU, referenced as IMU_1 460, is mounted within the case 310 (FIG. 3A) of the electrical actuator unit 302, which, as discussed above, is mounted in the dozer cab 106 (FIG. 1A). The IMU_1 460 can correspond to the IMU 120 in FIG. 1A. The second IMU, referenced as IMU_2 462, is mounted on the blade 104 and can correspond to the IMU 150 in FIG. 1A. The input 403B, including reference values of system parameters (see below), is entered into the computational system 402.

The computational system 402 receives the measurements 441-1 from the IMU_1 460 and the measurements 441-2 from the IMU_2 462, filters the measurements, and calculates an estimate of the body pitch angle $\theta_1$ 133, an estimate of the body roll angle $\theta_1$ 131 (FIG. 1A), and the mutual body-blade position. The computational system 402 calculates error signals by comparing the estimated values of the body pitch angle and the body roll angle with the reference values of the body pitch angle and the body roll angle, respectively, taking into account the mutual body-blade position. The body pitch angle and the body roll angle are functionally dependent on the blade elevation and the blade slope angle for the moving machine. Therefore, the computational system calculates corresponding estimated and reference values of the blade elevation and the blade slope angle. Control of the joystick 200 then proceeds as discussed above in reference to FIG. 4A. This semi-automatic control system works as a pitch and roll stabilization system (see US Patent Application Publication No. US 2010/0299031, previously cited).

Different schemes can be used for automatic elevation control. The choice can depend on operator preference. In one method, suitable for short-term adjustments, the operator returns the blade to a desired profile based on visual marks (for example, stakes, string, or a neighboring swath). The system first changes the elevation of the blade according to operator manual intervention; after the operator releases manual control, the system regains full automatic control of the elevation channel.

Another method, as described in US Patent Application Publication No. US 2010/0299031, previously cited, implements control via shifting a control point. The control point is a virtual point on the bottom surface of the dozer tracks that defines the condition under which the dozer configuration is in a state of equilibrium. Formally, the control point is defined as follows. Define $M_i$ as the moment of the i-th external force acting on the dozer (where i is an integer ranging from 1 to n), about a point placed on the bottom surface of the tracks. The control point is then defined by the equation:

$$\mathrm{abs}\left(\sum_{i=1}^{n} M_i\right) = \min. \tag{E1}$$

That is, the control point yields the minimum absolute value of the sum of the moments. The equation (E1) defines the condition under which the dozer configuration is in a state of equilibrium.

The blade is controlled such that the bottom edge of the blade and the control point are both placed on a desired (target) profile. In the case of an unloaded dozer, the control point is the bottom projection of the machine center of gravity. During machine operation, the equilibrium point changes its position due to the influence of external forces. In one implementation, the position of the control point is moved based on observation of dozer behavior. The operator visually observes the current blade height relative to reference objects (for instance, geodetic markers) or to features on the ground (for instance, a neighboring swath) located alongside of the current swath; the operator does not use an indicator display. Operation of the dozer is based on human reflex and prior knowledge of dozer behavior. The operator moves the control point manually to avoid long-term undesirable changes in dozer position: the operator manually shifts the control point to satisfy the condition of equation (E1).

According to another embodiment, the IMU_1 460 is not mounted within the case 310 of the electrical actuator 302. Instead, the IMU_1 460 is mounted to the dozer main frame 170 (FIG. 1A). In some dozers, the dozer cab 106 can have a suspension system (such as rubber blocks) for operator comfort; this suspension system separates the dozer cab and the dozer main frame. The changes in position and orientation of the case 310 can therefore differ from those of the dozer main frame 170; that is, the values of the body pitch angle and the body roll angle can vary as a function of the specific location on the dozer body 102 on which the IMU is mounted.

The resonance frequency of the electrical actuator unit can also differ from that of the dozer main frame. The effect of shock and vibration on the IMU varies with the resonance frequency; shock and vibration can result in incorrect pitch and roll estimations. Mounting the IMU_1 460 on the dozer main frame 170 reduces errors in the resulting ground profile because the blade 104 is coupled via the hydraulic cylinders to the dozer main frame 170, which, along with the chassis and tracks, rests on the ground.

In some dozers, only the operator's chair has a suspension; the dozer cab is rigidly mounted to the dozer main frame. For these dozers, installing the IMU_1 460 within the case 310 of the electrical actuator 302 can provide a less complex, less expensive, more convenient, and more compact solution than installing the IMU_1 460 separately on the dozer main frame. Since the dozer cab is rigidly mounted to the dozer main frame, an acceptable degree of accuracy can be achieved.

FIG. 4C shows a schematic block diagram of an embodiment of a semi-automatic control system with two inertial measurement units (IMUs) and a GNSS sensor (antenna) and GNSS receiver. A GNSS sensor and GNSS receiver combined correspond to a measurement unit. The IMUs are the same as those discussed above in reference to FIG. 4B. A GNSS sensor 140 (antenna) is mounted on the roof 108 of the dozer cab 106 (FIG. 1A). Satellite signals received by the GNSS sensor 140 are processed by a GNSS receiver 464, which can be located, for example, within the dozer cab 106 or on the roof 108. The GNSS receiver 464 can provide centimeter-level accuracy of the coordinates of the GNSS sensor 140. These coordinates are included as measurements 441-3. The input 403C, including specific reference values, is entered into the computational system 402.

The computational system 402 receives the measurements 441-1 from the IMU_1 460, the measurements 441-2 from the IMU_2 462, and the measurements 441-3 from the GNSS receiver 464. The computational system 402 executes algorithms based on a Kalman filter approach and determines accurate three-dimensional (3D) coordinates of the blade. The embodiment shown in FIG. 4C eliminates any drift associated with elevation control in the embodiment shown in FIG. 4B. The computational system 402 calculates error signals by comparing the calculated values of the 3D blade coordinates and the blade roll angle with the reference values. The computational system 402 then calculates corresponding estimated and reference values of the blade elevation and the blade slope angle. Control of the joystick 200 then proceeds as discussed above in reference to FIG. 4A.

Various means can be used for providing operator input to the control system. For example, input devices can include equipment (such as an additional electrical joystick, a dial, or slider switches) that control changes in the blade elevation or the control point position. This configuration has general applicability. In general, input devices can include both the I/O devices 404 operably coupled to the computational system 402 and input devices not operably coupled to the computational system 402.

In an embodiment, input devices can be positioned on the case 310 of the electrical actuator unit 302 (FIG. 3A) or on the shelf 122. The input devices can include a keyboard (for example, a film or button type) and indicators [for example, light-emitting diode (LED) or liquid-crystal display (LCD)] to allow the operator or control engineer to setup various aspects of the system. Setup parameters include, for example, dozer geometry, IMUs mounting offsets calibration, reference pitch and roll settings (these can be entered by buffering the current ones or entered via the keyboard), and actuator nonlinearity calibration (include dead band). A convenient and general implementation can also use the video display 124 (FIG. 1A), with an integrated keyboard or touchscreen, placed on the gauge board of the machine or integrated into it.

Figure 5:
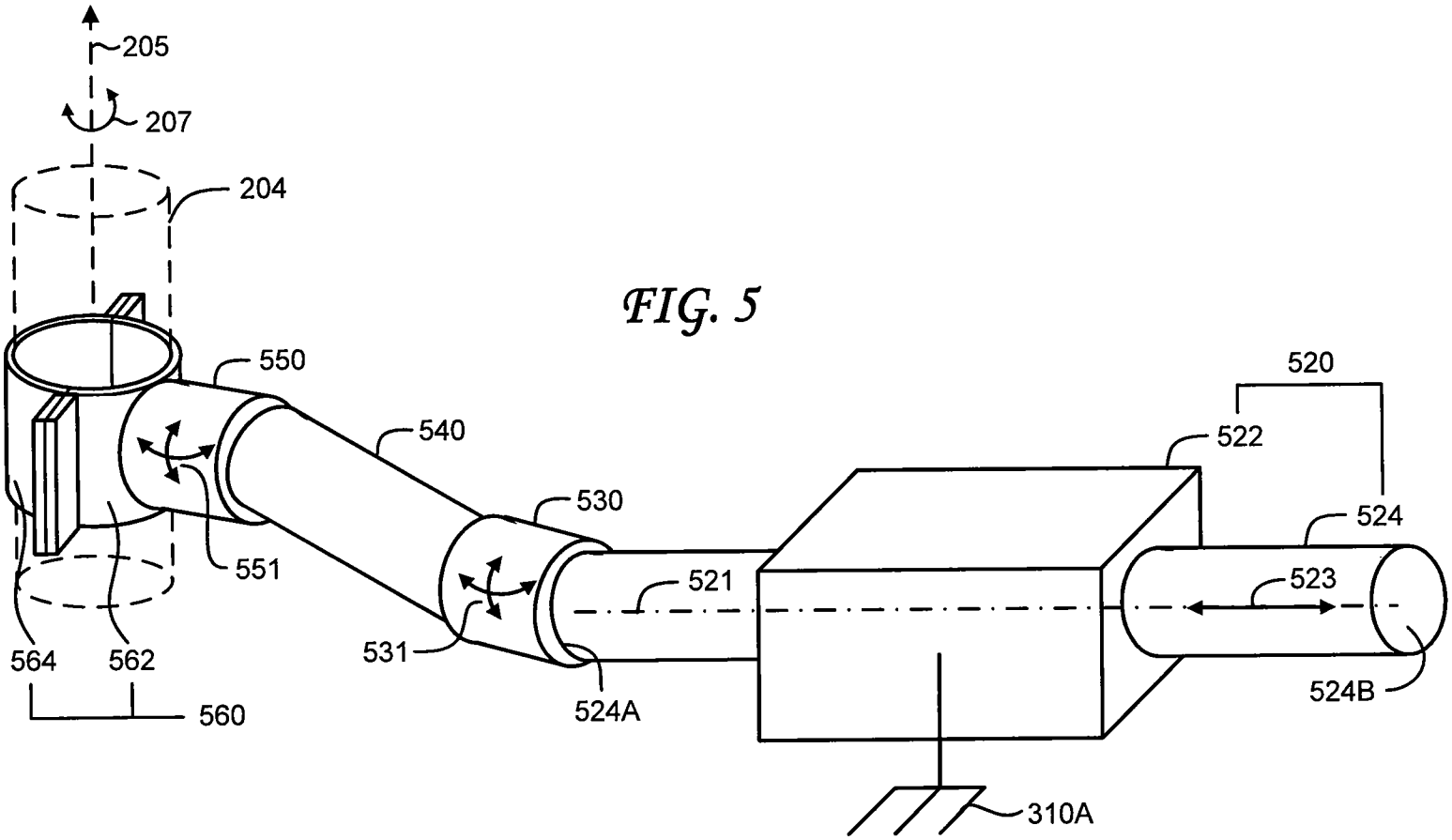
FIG. 5 shows a schematic of an embodiment of a motor and mechanical linkage used in an electrical actuator unit.

FIG. 5 shows an embodiment of an electrical motor assembly used in the electrical actuator unit 302. This embodiment shows examples of components for implementing the semi-automatic control system and examples of interfaces between the components. The motor 520 is rigidly mounted to the case 310 (FIG. 3A), which is then rigidly mounted to the dozer body. The motor 520 moves the joystick 200 (FIG. 3A) along one translation axis (Y'-axis). The semi-automatic control system also needs to accommodate the passive degrees of freedom described above. Various coupling joints and forks can be used. Forks, however, are not desirable because of low service life due to a high level of friction. The number of joints should also be kept to a minimum as well to make the semi-automatic control system as reliable as possible.

FIG. 5 shows an embodiment based on a linear tubular motor. The motor 520 controls the elevation channel (elevation of the blade 104). The motor 520 includes the stator 522 and the slider 524. The stator 522 is rigidly mounted to the case 310 at the location 310A. The slider 524 is a tube filled with strong rare-earth permanent magnets. The slider 524 can be moved along the longitudinal axis 521 of the motor 520 by applying electrical voltage or current to the coil in the stator 522; translation 523 along the longitudinal axis 521 implements the active degree of freedom. The stator 522 has an embedded encoder that senses the position of the slider 524.

The slider 524 has two end faces. The end face 524B is free. The coupling joint 530 is mounted to the end face 524A. The coupling joint 530 couples one end of the extender 540 to the slider 524. The coupling joint 550 in turn couples the other end of the extender 540 to part 562 of the split coupling 560. During installation, part 562 of the split coupling 560 is placed around the joystick rod 204 (FIG. 2A); part 564 of the split coupling 560 then secures the joystick rod in place. The split coupling 560 does not clamp rigidly onto the joystick rod 204: the split coupling 560 can slide along the joystick 204 (see discussion below). A split coupling can be used for all joysticks (with detachable handles and without detachable handles). For joysticks with detachable handles, a one-piece coupling can be used: the handle is detached, the one-piece coupling is slipped over the joystick rod, and the handle is re-attached.

Refer to FIG. 3A. Here, the coupling 306 corresponds to the split coupling 560, and the mechanical linkage 304 corresponds to the coupling assembly comprising the coupling joint 550, the extender 540, and the coupling joint 530.

The combination of the coupling joint 530, the extender 540, the coupling joint 550, and the split coupling 560 provides the requisite passive degrees of freedom to allow: (a) manual translation of the joystick rod 204 along the X'-axis 203 (FIG. 3A) for manual control of the blade slope angle; (b) rotation 207 of the joystick rod 204 about its longitudinal (central) axis 205 for manual control of the blade heading angle; and (c) translation of the split coupling 560 along the longitudinal axis 205 of the joystick rod 204 to compensate for changes in height during operation of the joystick (as previously explained with reference to FIG. 2B, FIG. 2D, and FIG. 2E).

The coupling joint 530 has at least two rotation degrees of freedom 531. Similarly, the coupling joint 550 has at least two rotation degrees of freedom 551. For correct operation, the input axis and the output axis of each coupling joint should return to a coaxial state once an external torque has been removed. Conventional metal-rubber coupling joints, for example, can be used.

Other types of linear motors, such as voice coil motors, flat magnet servomotors, and even solenoids, can be used. Other coupling assemblies can be used to couple the linear motor to the joystick rod. Other kinematic geometries can be used.

Figure 7:
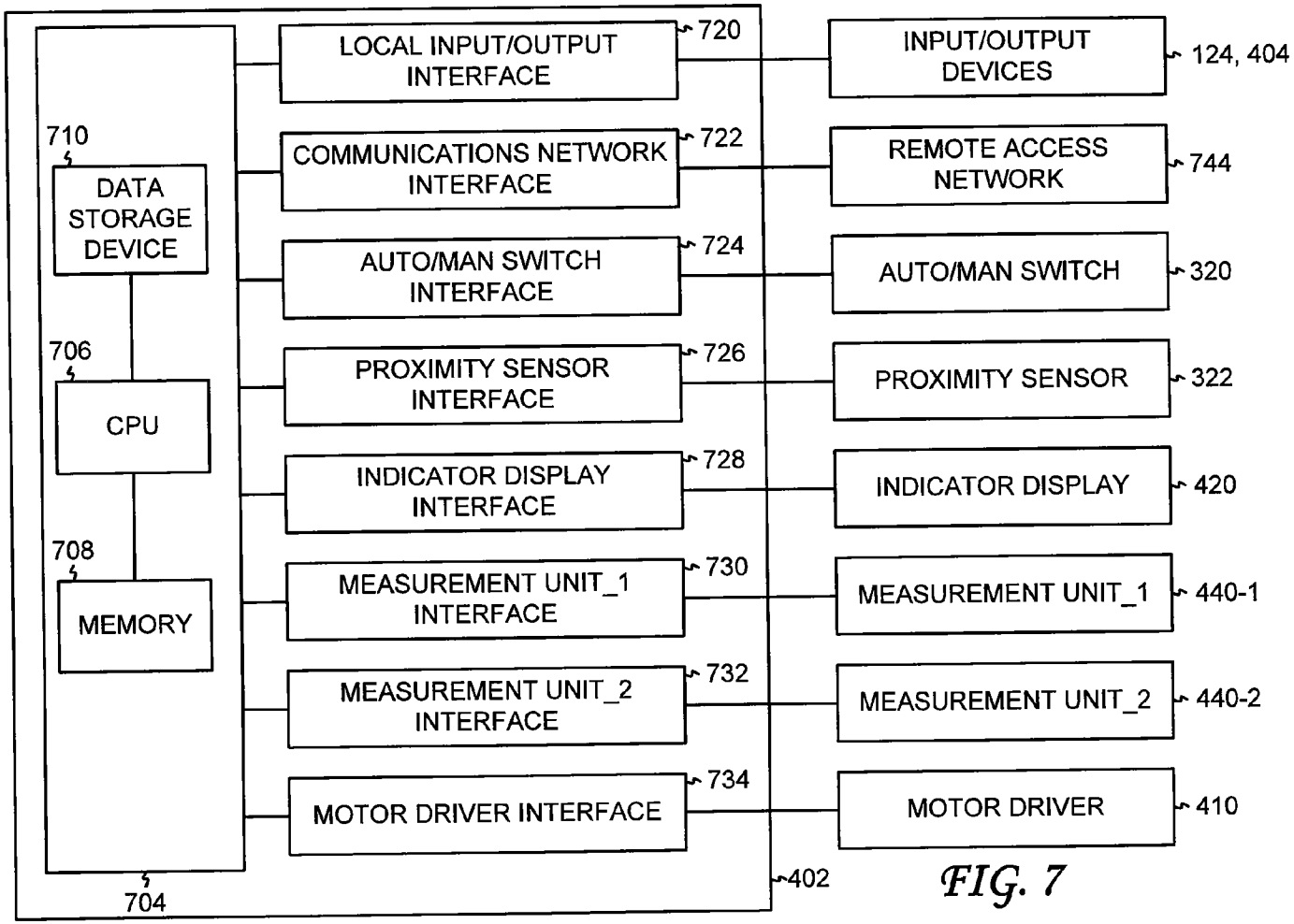
FIG. 7 shows a schematic of a computational system used in an electrical actuator unit.

FIG. 7 shows a schematic of an embodiment of the computational system 402 used in the electrical actuator unit 302 (FIG. 4A-FIG. 4C). In one configuration, the computational system 402 is housed in the case 310 of the electrical actuator unit 302 (FIG. 3A); however, it can also be a separate unit. One skilled in the art can construct the computational system 402 from various combinations of hardware, firmware, and software. One skilled in the art can construct the computational system 402 from various electronic components, including one or more general purpose microprocessors, one or more digital signal processors, one or more application-specific integrated circuits (ASICs), and one or more field-programmable gate arrays (FPGAs).

The computational system 402 comprises a computer 704, which includes a processor [central processing unit (CPU)] 706, memory 708, and a data storage device 710. The data storage device 710 includes at least one persistent, tangible, non-transitory computer readable medium, such as semiconductor memory, a magnetic hard drive, or a compact disc read only memory. In an embodiment, the computer 704 is implemented as an integrated device.

The computational system 402 can further comprise a local input/output interface 720, which interfaces the computer 704 to one or more input/output (I/O) devices 404 (FIG. 4A-FIG. 4C) or video display 124 (FIG. 1A). Examples of input/output devices 404 include a keyboard, a mouse, a touch screen, a joystick, a switch, and a local access terminal. Data, including computer executable code, can be transferred to and from the computer 704 via the local input/output interface 720. A user can access the computer 402 via the input/output devices 404. Different users can have different access permissions. For example, if the user is a dozer operator, he could have restricted permission only to enter reference values of blade elevation and blade orientation. If the user is a control engineer or system installation engineer, however, he could also have permission to enter control algorithms and setup parameters.

The computational system 402 can further comprise a communications network interface 722, which interfaces the computer 704 with a remote access network 744. Examples of the remote access network 744 include a local area network and a wide area network. A user can access the computer 704 via a remote access terminal (not shown) connected to the remote access network 744. Data, including computer executable code, can be transferred to and from the computer 704 via the communications network interface 722.

The computational system 402 can further comprise: an auto/man switch interface 724, which interfaces the computer 704 with the auto/man switch 320; a proximity sensor interface 726, which interfaces the computer 704 with the proximity sensor 322; and an indicator display interface 728 which interfaces the computer 704 with the indicator display 420 (FIG. 4A-FIG. 4C).

The computational system 402 can further comprise one or more measurement unit interfaces, such as the measurement unit_1 interface 730 and the measurement unit_2 interface 732, which interface the computer 704 with the measurement unit_1 440-1 and the measurement unit_2 440-2, respectively (FIG. 4A). A measurement unit can also interface to the computer 704 via the local input/output interface 720 or the communications network interface 722.

The computational system 402 can further comprise a motor driver interface 734, which interfaces the computer 704 with the motor driver 410 (FIG. 4A-FIG. 4C).

The interfaces in FIG. 7 can be implemented over various transport media. For example, an interface can transmit and receive electrical signals over wire or cable, optical signals over optical fiber, electromagnetic signals (such as radiofrequency signals) wirelessly, and free-space optical signals.

As is well known, a computer operates under control of computer software, which defines the overall operation of the computer and applications. The CPU 706 controls the overall operation of the computer and applications by executing computer program instructions that define the overall operation and applications. The computer program instructions can be implemented as computer executable code programmed by one skilled in the art. The computer program instructions can be stored in the data storage device 710 and loaded into memory 708 when execution of the program instructions is desired. For example, the control algorithm shown schematically in FIG. 8, and the overall control loops shown schematically in FIG. 4A-FIG. 4C, can be implemented by computer program instructions. Accordingly, by executing the computer program instructions, the CPU 706 executes the control algorithm and the control loops.

FIG. 9A-FIG. 9F show a flowchart summarizing a method, according to an embodiment of the invention, for semi-automatically controlling a joystick in which a first translation of the joystick controls a first degree of freedom (DOF) of an implement operably coupled to a vehicle body and a second translation of the joystick controls a second degree of freedom of the implement.

Figure 9A:
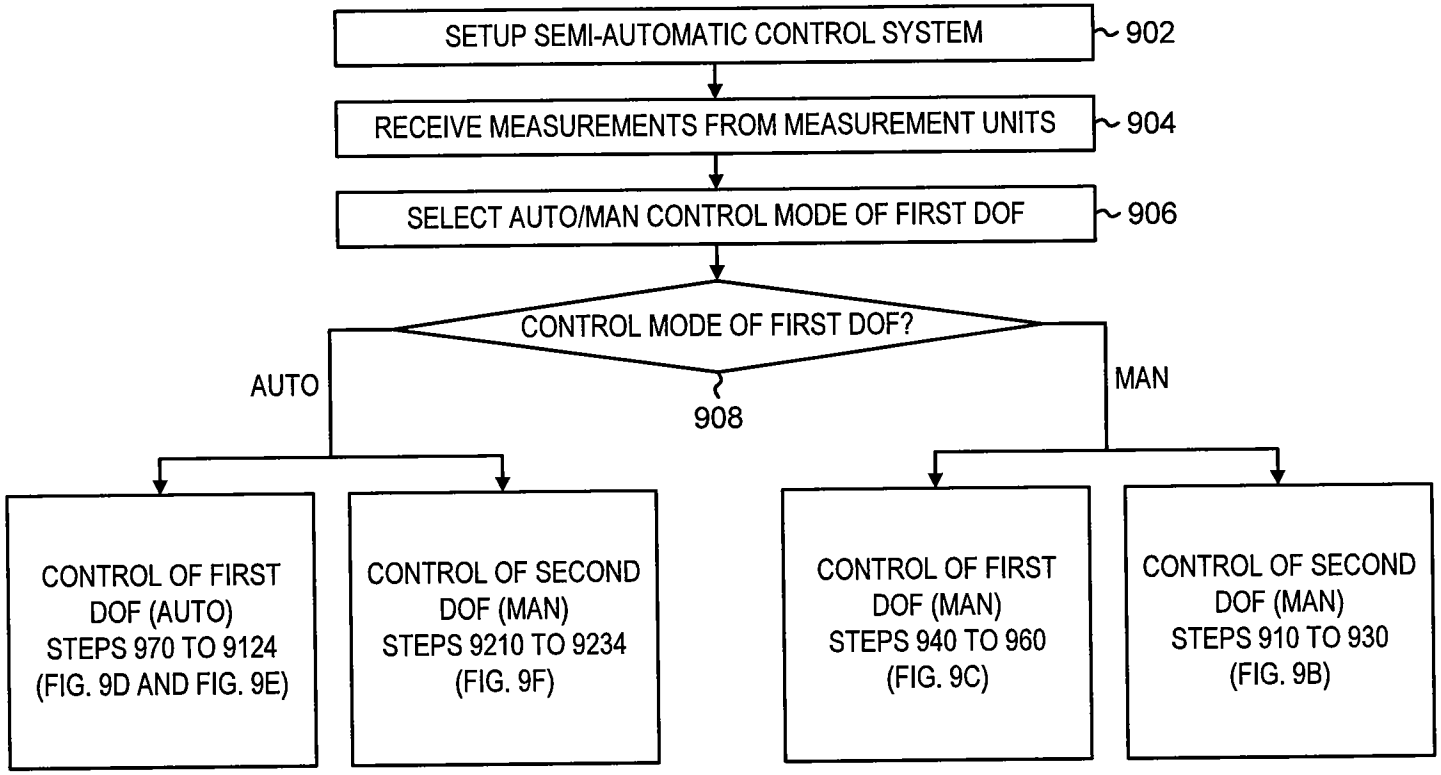
FIG. 9A-FIG. 9F show a flowchart of a method for semi-automatically controlling an implement operably coupled to a vehicle body.

Refer to FIG. 9A. In step 902, the semi-automatic control system is setup. Preliminary manual operations are completed. Control algorithms and reference (target) values are stored in a computational system. The reference values can be entered by an operator, generated by buffering (storing) a current measured value, or generated from a digital model. As discussed above, the stored reference values can be direct reference values of the first DOF and the second DOF, or the stored reference values can be reference values of system parameters from which reference values of the first DOF and the second DOF can be calculated. Reference values can be dynamically updated.

Figure 9B:
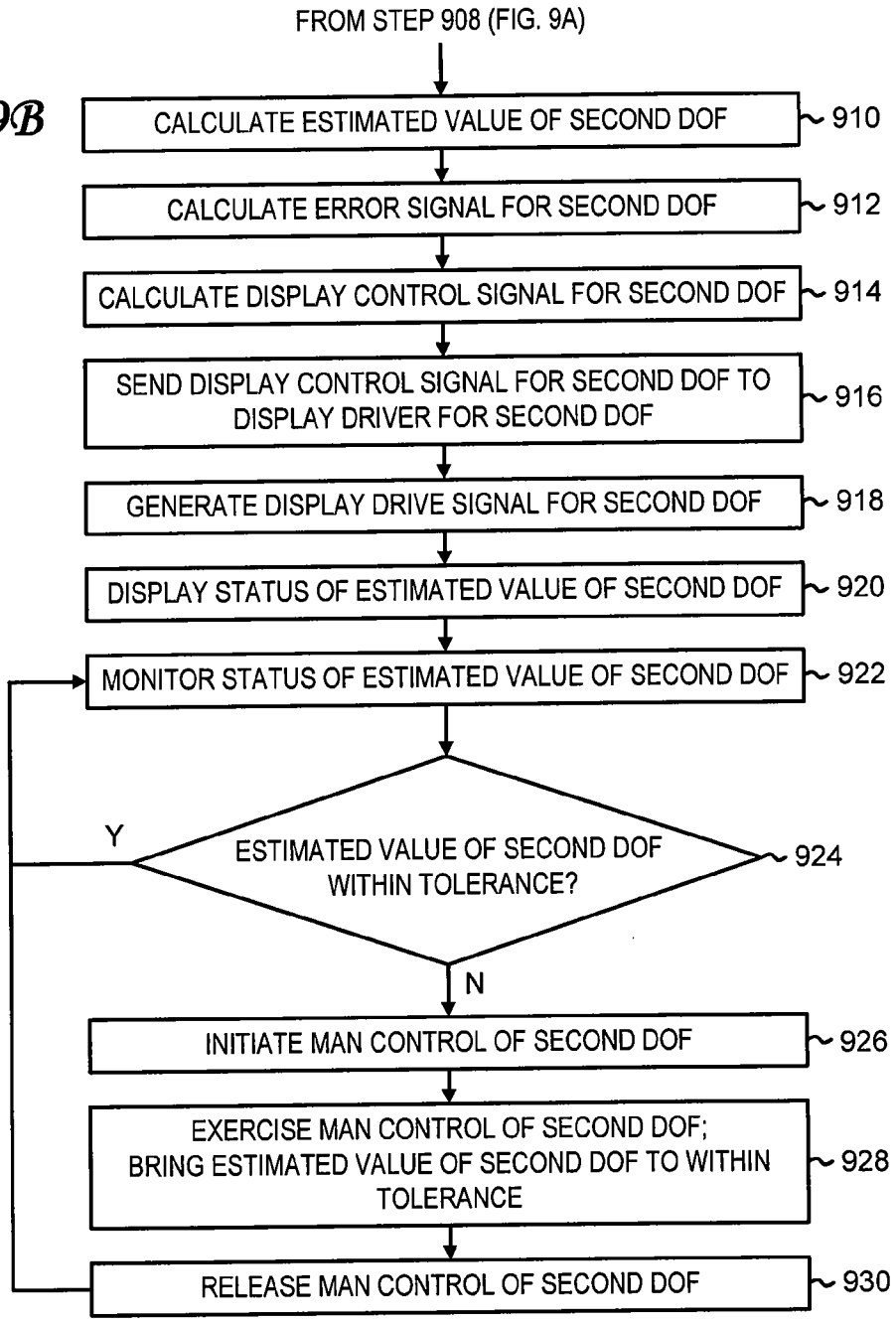
Figure 9C:
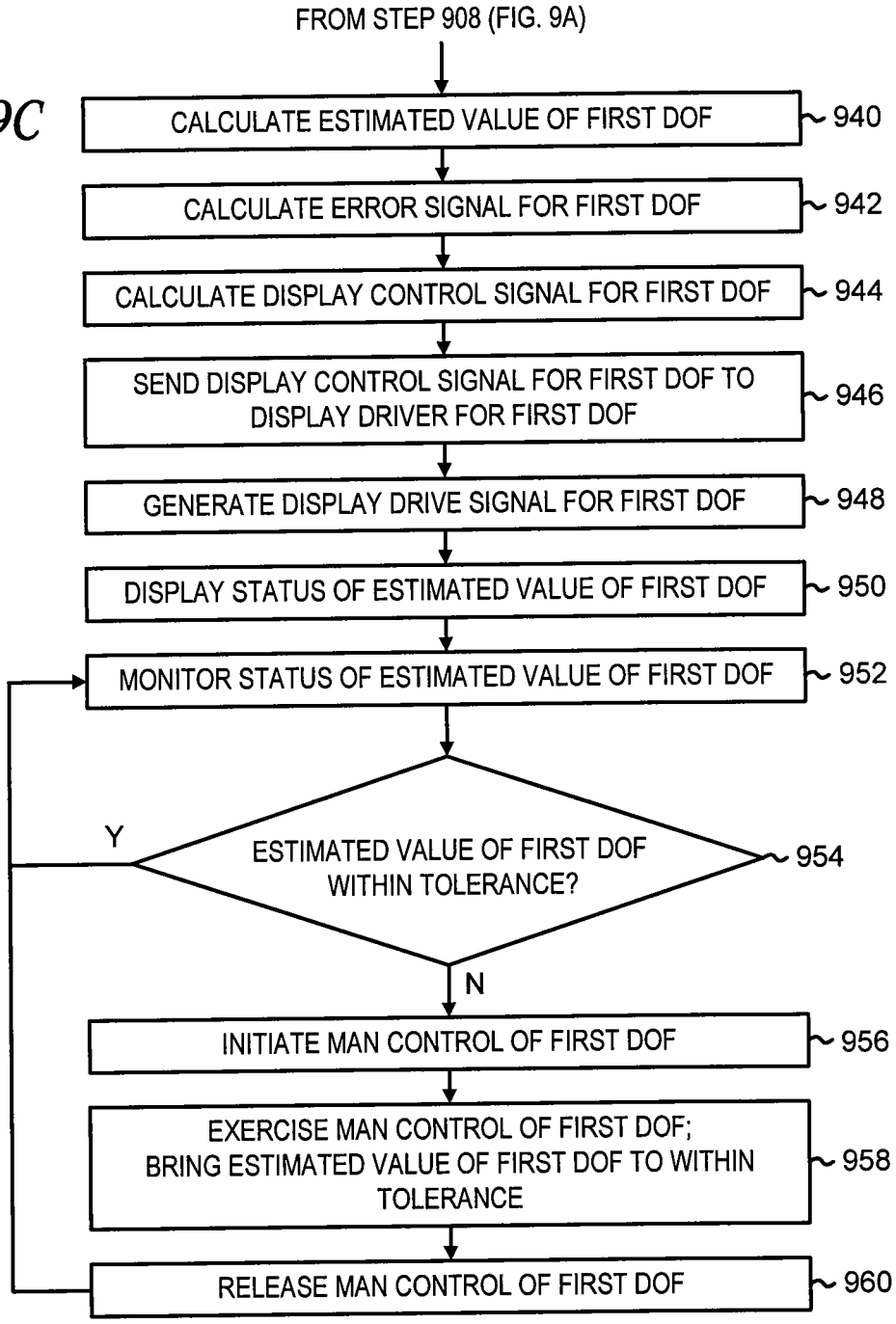

The process then passes to step 904, in which the computational system receives sets of measurements from at least one measurement unit mounted on the vehicle body, the implement, or both the vehicle body and the implement. The process then passes to step 906, in which the operator selects the control mode (auto/man) of the first DOF via an auto/man switch; the control mode of the second DOF is always manual. The process then passes to the decision step 908. If the control mode of the first DOF is manual, then the process passes to steps 910-930 (FIG. 9B) for manual control of the second DOF and to steps 940-960 for manual control of the first DOF (FIG. 9C). If the control mode of the first DOF automatic, then the process passes to steps 9210-9234 (FIG. 9F) for manual control of the second DOF and to steps 970-9124 (FIG. 9D and FIG. 9E) for automatic control of the first DOF.

Refer back to step 906. First assume that manual control mode of the first DOF is selected. The electrical motor and the proximity sensor are not activated.

The process for manual control of the second DOF is first described. Refer to FIG. 9B. In step 910, based at least in part on the sets of measurements received in step 904, the computational system calculates an estimated value of the second DOF. The process then passes to step 912. Based at least in part on the estimated value of the second DOF and a reference value of the second DOF, the computational system calculates an error signal corresponding to the second DOF. The process then passes to step 914. Based at least in part on the error signal corresponding to the second DOF, the computational system calculates a display control signal corresponding to the second DOF. The process then passes to step 916, in which the computational system sends the display control signal corresponding to the second DOF to a display driver for the second DOF.

The process then passes to step 918. Based at least in part on the display control signal corresponding to the second DOF, the display driver generates a display drive signal corresponding to the second DOF. The process then passes to step 920. In response to the display drive signal corresponding to the second DOF, the status of the estimated value of the second DOF is displayed on an indicator display (a graphical representation of the difference between the estimated value of the second DOF and the reference value of the second DOF is displayed on the indicator display).

The process then passes to step 922, in which the operator visually monitors the status of the estimated value of the second DOF on the indicator display. The process then passes to the decision step 924. If the estimated value of the second DOF is within tolerance, then the process returns to step 922. If the estimated value of the second DOF is not within tolerance, then the process passes to step 926, in which the operator initiates manual control of the second DOF: that is, he grips the joystick.

The process then passes to step 928, in which the operator exercises manual control of the second DOF: the operator manually translates the joystick to bring the estimated value of the second DOF to within tolerance (close to zero error).

The process then passes to step 930, in which the operator releases manual control. The process then returns to step 922.

The process for manual control of the first DOF is now described. In some embodiments, such as described above for manual control of the blade elevation, the operator manually controls the first DOF by visually observing the current blade height relative to reference objects or features on the job site: an indicator display is not used.

In other embodiments, manual control of the first DOF is similar to manual control of the second DOF. Refer to FIG. 9C. In step 940, based at least in part on the sets of measurements received in step 904, the computational system calculates an estimated value of the first DOF. The process then passes to step 942. Based at least in part on the estimated value of the first DOF and a reference value of the first DOF, the computational system calculates an error signal corresponding to the first DOF. The process then passes to step 944. Based at least in part on the error signal corresponding to the first DOF, the computational system calculates a display control signal corresponding to first DOF. The process then passes to step 946, in which the computational system sends the display control signal corresponding to the first DOF to a display driver for the first DOF.

The process then passes to step 948. Based at least in part on the display control signal corresponding to the first DOF, the display driver generates a display drive signal corresponding to the first DOF. The process then passes to step 950. In response to the display drive signal corresponding to the first DOF, the status of the estimated value of the first DOF is displayed on an indicator display (a graphical representation of the difference between the estimated value of the first DOF and the reference value of the first DOF is displayed on the indicator display).

The process then passes to step 952, in which the operator visually monitors the status of the estimated value of the first DOF on the indicator display. The process then passes to the decision step 954. If the estimated value of the first DOF is within tolerance, then the process returns to step 952. If the estimated value of the first DOF is not within tolerance, then the process passes to step 956, in which the operator initiates manual control of the first DOF: that is, he grips the joystick.

The process then passes to step 958, in which the operator exercises manual control of the first DOF: the operator manually translates the joystick to bring the estimated value of the first DOF to within tolerance (close to zero error). The process then passes to step 960, in which the operator releases manual control. The process then returns to step 952.

Refer back to step 906 (FIG. 9A). Now assume that the automatic control mode of the first DOF is selected. The control mode of the second DOF is still manual. Since the electrical motor and the proximity sensor are activated, however, the sequence of steps (steps 9210-9234) for manual control of the second DOF in this instance is not identical to the previous sequence of steps (steps 910-930) for manual control of the second DOF.

Figure 9D:
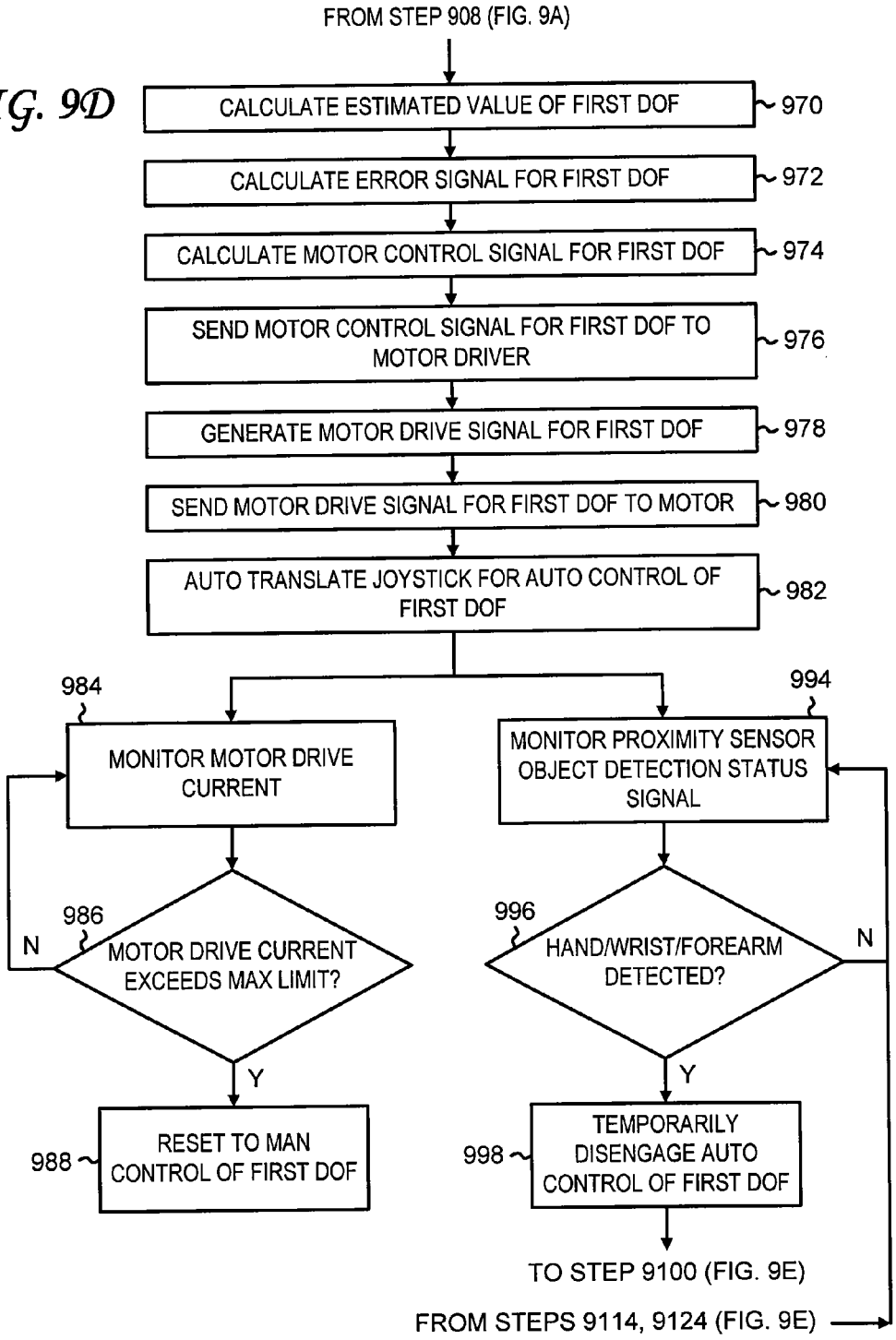

The process for manual control of the second DOF is first described. Refer to FIG. 9F. In step 9210, based at least in part on the sets of measurements received in step 904, the computational system calculates an estimated value of the second DOF. The process then passes to step 9212. Based at least in part on the estimated value of the second DOF and a reference value of the second DOF, the computational system calculates an error signal corresponding to the second DOF. The process then passes to step 9214. Based at least in part on the error signal corresponding to the second DOF, the computational system calculates a display control signal corresponding to the second DOF. The process then passes to step 9216, in which the computational system sends the display control signal corresponding to the second DOF to a display driver for the second DOF.

The process then passes to step 9218. Based at least in part on the display control signal corresponding to the second DOF, the display driver generates a display drive signal corresponding to the second DOF. The process then passes to step 9220. In response to the display drive signal corresponding to the second DOF, the status of the estimated value of the second DOF is displayed on an indicator display (a graphical representation of the difference between the estimated value of the second DOF and the reference value of the second DOF is displayed on the indicator display).

The process then passes to step 9222, in which the operator visually monitors the status of the estimated value of the second DOF on the indicator display. The process then passes to the decision step 9224. If the estimated value of the second DOF is within tolerance, then the process returns to step 9222. If the estimated value of the second DOF is not within tolerance, then the process passes to step 9226, in which the operator initiates manual control of the second DOF: that is, he starts to reach for the joystick. The process then passes to step 9228 in which at least a portion of the operator's hand or wrist or forearm triggers the proximity sensor and temporarily disengages auto control of the first DOF (see below).

The process then passes to step 9230, in which the operator exercises manual control of the second DOF: the operator manually translates the joystick to bring the estimated value of the second DOF to within tolerance (close to zero error). The process then passes to step 9232, in which the operator releases manual control. The process then passes to step 9234, in which the operator's hand, wrist, and forearm clear the proximity sensor and return to the at-rest position. The auto control mode of the first DOF is re-engaged. The process then returns to step 9222.

In some embodiments, when the estimated value of the second DOF is out of tolerance, the computational system, in step 9226, will automatically temporarily disengage auto control of the first DOF prior to the operator taking action. In response to an out-of-tolerance indicator on the indicator display, the operator starts to reach for the joystick and triggers the proximity sensor. Once the operator has exercised manual control to bring the estimated value of the second DOF to within tolerance, the proximity sensor then prevents the auto control mode for the first DOF from re-engaging until the proximity sensor is clear (that is, until the operator has released the joystick and has returned his hand, wrist, and forearm to the at-rest position).

The process for automatic control mode of the first DOF is now described. Refer to FIG. 9D. In step 970, based at least in part on the sets of measurements received in step 904, the computational system calculates an estimated value of the first DOF. The process then passes to step 972. Based at least in part on the estimated value of the first DOF and a reference value of the first DOF, the computational system calculates an error signal corresponding to the first DOF. The process then passes to step 974. Based at least in part on the error signal corresponding to the first DOF, the computational system calculates a motor control signal corresponding to the first DOF.

The process then passes to step 976, in which the computational system sends the motor control signal corresponding to the first DOF to a motor driver. The process then passes to step 978. Based at least in part on the motor control signal corresponding to the first DOF, the motor driver generates a motor drive signal corresponding to the first DOF. The process then passes to step 980, in which the motor driver sends the motor drive signal to an electrical motor. The electrical motor is operably coupled to a mechanical linkage, and the mechanical linkage is operably coupled to the joystick.

The process then passes to step 982. In response to the motor drive signal corresponding to the first DOF, the electrical motor automatically controls the mechanical linkage to translate along an automatically-controlled mechanical linkage trajectory and automatically controls the joystick to translate along an automatically-controlled joystick trajectory corresponding to the automatically-controlled mechanical linkage trajectory. The correspondence between the joystick trajectory and the mechanical linkage trajectory depends on the coupling between the joystick and the mechanical linkage.

Once the joystick is in the auto mode, two status conditions are monitored in parallel. In step 984, the computational system monitors the motor drive current. The process then passes to the decision step 986. If the motor drive current does not exceed a maximum limit (defined, for example, by a control engineer), the process returns to step 984. If the motor drive current does exceed the maximum limit, then the process passes to step 988, in which the control mode of the first DOF is reset to manual. To return the control mode of the first DOF to auto, the operator needs to press the auto/man switch again.

In step 994, the computational system monitors the object detection status signal sent from the proximity sensor. The process then passes to the decision step 996. If at least a portion of the operator's hand or wrist or forearm is not detected, then the process returns to step 994. If at least a portion of the operator's hand or wrist or forearm is detected, then the process passes to step 998, in which auto control of the first DOF is temporarily disengaged.

Figure 9E:
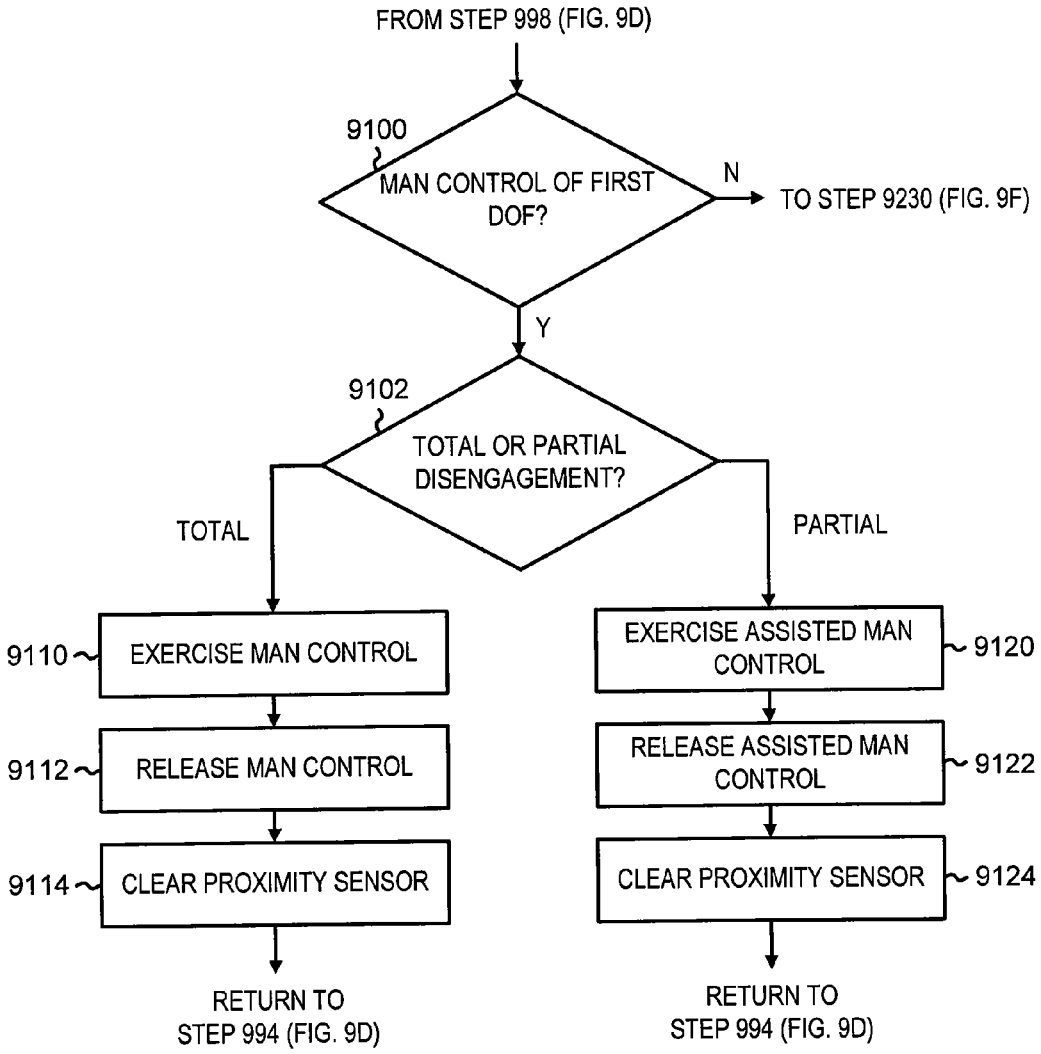
Figure 9F:
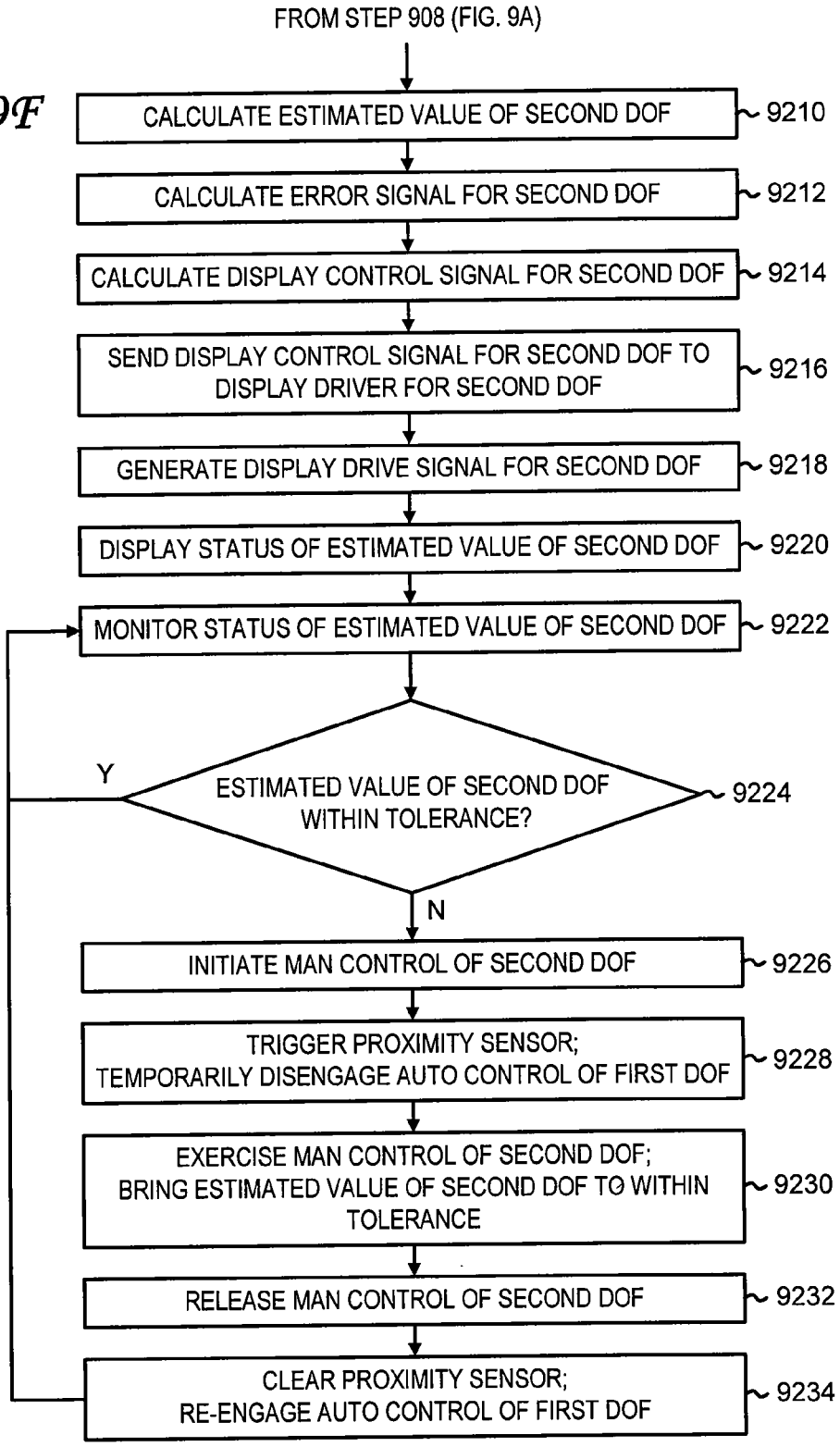

The process then passes to the decision step 9100 (FIG. 9E). The proximity sensor detects at least a portion of the operator's hand or wrist or forearm when the operator needs to manually control the first DOF or the second DOF. If manual control of the first DOF is not needed, then the process passes to step 9230 (FIG. 9F) for manual control of the second DOF. If manual control of the first DOF is needed, then the process passes to the decision step 9102.

Temporary disengagement of the auto mode can be total or partial; the choice of total or partial disengagement mode is configured during initial setup. For some control systems, partial disengagement of the auto mode of the first DOF, with subsequent assisted manual control of the first DOF, is advantageous: disengaging the auto mode totally can, under some circumstances, increase the error in a controlled system parameter.

If the temporary disengagement is total, then the process passes to step 9110, in which the motor drive current is turned off (for example, the computational system can generate no control signal for the first DOF; alternatively, the computational system can generate a null (zero) control signal for the first DOF) and the operator exercises full manual control of the joystick for the first DOF. When the operator completes the manual control operation, the process then passes to step 9112, in which the operator releases manual control. The process then passes to step 9114, in which the proximity sensor is cleared, and the operator returns his hand, wrist, and forearm to the at-rest position. The process then returns to step 994 (FIG. 9D).

Refer back to the decision step 9102. If the temporary disengagement is partial, then the process passes to step 9120, in which the operator exercises assisted manual control of the first DOF. In assisted manual control, the motor drive current is not turned completely off: instead, the gain factor K in the control algorithm (FIG. 8) is reduced. The maximum translation speed of the joystick in the partially-disengaged auto mode is reduced relative to the maximum translation speed of the joystick in the normal (fully-engaged) auto mode such that the operator can readily grip the slowly-moving joystick and such that the operator can manually translate the joystick without forcing the motor drive current to exceed the maximum limit. When the operator completes the assisted manual control operation, the process then passes to step 9122, in which the operator releases the assisted manual control. The process then passes to step 9124, in which the proximity sensor is cleared, and the operator returns his hand, wrist, and forearm to the at-rest position. The process then returns to step 994 (FIG. 9D).

The foregoing Detailed Description is to be understood as being in every respect illustrative and exemplary, but not restrictive, and the scope of the invention disclosed herein is not to be determined from the Detailed Description, but rather from the claims as interpreted according to the full breadth permitted by the patent laws. It is to be understood that the embodiments shown and described herein are only illustrative of the principles of the present invention and that various modifications may be implemented by those skilled in the art without departing from the scope and spirit of the invention. Those skilled in the art could implement various other feature combinations without departing from the scope and spirit of the invention.

The invention claimed is:

1. A system for controlling a joystick, wherein a first translation of the joystick controls a first degree of freedom of an implement operably coupled to a vehicle body, and wherein a second translation of the joystick controls a second degree of freedom of the implement, the system comprising:

at least one measurement unit mounted on at least one of the vehicle body or the implement, wherein the at least one measurement unit is configured to generate at least one plurality of measurements;

a proximity sensor configured to:

in response to not detecting at least a portion of an object selected from a group consisting of a hand, a wrist, and a forearm, generate a first object detection signal; and in response to detecting at least a portion of an object selected from the group consisting of a hand, a wrist, and a forearm, generate a second object detection signal;

a computational system configured to:

receive the at least one plurality of measurements;

calculate, based at least in part on the at least one plurality of measurements, an estimated value of the first degree of freedom;

calculate, based at least in part on the estimated value of the first degree of freedom and a reference value of the first degree of freedom, an error signal corresponding to the first degree of freedom;

in response to receiving the first object detection signal, calculate, based at least in part on the error signal corresponding to the first degree of freedom, a first motor control signal;

calculate, based at least in part on the at least one plurality of measurements, an estimated value of the second degree of freedom;

calculate, based at least in part on the estimated value of the second degree of freedom and a reference value of the second degree of freedom, an error signal corresponding to the second degree of freedom; and calculate, based at least in part on the error signal corresponding to the second degree of freedom, a display control signal corresponding to the second degree of freedom; and in response to receiving the second object detection signal, calculate, based at least in part on the error signal corresponding to the first degree of freedom, a second motor control signal;

a motor driver configured to:

in response to receiving the first motor control signal, generate a first motor drive signal;

in response to receiving the second motor control signal, generate a second motor drive signal;

a mechanical linkage operably coupled to the joystick;

an electrical motor operably coupled to the mechanical linkage, wherein the electrical motor is configured to:

in response to receiving the first motor drive signal, automatically control the mechanical linkage to translate along a first automatically-controlled mechanical linkage trajectory and automatically control the joystick to translate along a first automatically-controlled joystick trajectory corresponding to the first automatically-controlled mechanical linkage trajectory, wherein a translation speed of the joystick has a first maximum value;

in response to receiving the second motor drive signal, automatically control the mechanical linkage to translate along a second automatically-controlled mechanical linkage trajectory and automatically control the joystick to translate along a second automatically-controlled joystick trajectory corresponding to the second automatically-controlled mechanical linkage trajectory, wherein the translation speed of the joystick has a second maximum value less than the first maximum value;

a display driver configured to:

in response to receiving the display control signal corresponding to the second degree of freedom, generate a display drive signal corresponding to the second degree of freedom; and an indicator display configured to:

in response to receiving the display drive signal corresponding to the second degree of freedom, display a graphical representation of a difference between the estimated value of the second degree of freedom and the reference value of the second degree of freedom.

2. The system of claim 1, wherein the computational system is further configured to:

in response to receiving the second object detection signal, not generate a motor control signal.

3. The system of claim 1, wherein:

the computational system is further configured to:

calculate, based at least in part on the error signal corresponding to the first degree of freedom, a display control signal corresponding to the first degree of freedom;

the display driver is further configured to:

in response to receiving the display control signal corresponding to the first degree of freedom, generate a display drive signal corresponding to the first degree of freedom; and the indicator display is further configured to:

in response to receiving the display drive signal corresponding to the first degree of freedom, display a graphical representation of a difference between the estimated value of the first degree of freedom and the reference value of the first degree of freedom.

4. The system of claim 1, wherein:

the vehicle body comprises a dozer body;

the implement comprises a blade;

the first degree of freedom of the implement comprises a blade elevation; and the second degree of freedom of the implement comprises a blade slope angle.

5. The system of claim 4, wherein the at least one measurement unit comprises an inertial measurement unit mounted on the blade.

6. The system of claim 4, wherein the at least one measurement unit comprises an inertial measurement unit mounted on the vehicle body.

7. The system of claim 4, wherein the at least one measurement unit comprises:

a global navigation satellite system antenna mounted on the dozer body; and a global navigation satellite system receiver mounted on the dozer body.

8. The system of claim 4, wherein the at least one measurement unit comprises:

a global navigation satellite system antenna mounted on the blade; and a global navigation satellite system receiver mounted on the blade or on the dozer body.

9. A method for controlling a joystick, wherein a first translation of the joystick controls a first degree of freedom of an implement operably coupled to a vehicle body, wherein a second translation of the joystick controls a second degree of freedom of the implement, and wherein an electrical motor is operably coupled to the joystick with a mechanical linkage, the method comprising the steps of:

receiving at least one plurality of measurements from at least one measurement unit mounted on at least one of the vehicle body or the implement;

generating a first object detection signal or a second object detection signal, wherein:

the first object detection signal is generated in response to not detecting at least a portion of an object selected from a group consisting of a hand, a wrist, and a forearm; and the second object detection signal is generated in response to detecting at least a portion of an object selected from the group consisting of a hand, a wrist, and a forearm;

calculating, based at least in part on the at least one plurality of measurements, an estimated value of the first degree of freedom;

calculating, based at least in part on the estimated value of the first degree of freedom and a reference value of the first degree of freedom, an error signal corresponding to the first degree of freedom;

in response to the first object detection signal:

calculating, based at least in part on the error signal corresponding to the first degree of freedom, a first motor control signal;

generating, based at least in part on the first motor control signal, a first motor drive signal; and driving the electrical motor with the first motor drive signal to translate the joystick along a first automatically-controlled joystick trajectory, wherein a translation speed of the joystick has a first maximum value;

in response to the second object detection signal:

calculating, based at least in part on the error signal corresponding to the first degree of freedom, a second motor control signal;

generating, based at least in part on the second motor control signal, a second motor drive signal; and driving the electrical motor with the second motor drive signal to translate the joystick along a second automatically-controlled joystick trajectory, wherein the translation speed of the joystick has a second maximum value less than the first maximum value;

calculating, based at least in part on the at least one plurality of measurements, an estimated value of the second degree of freedom; and displaying a graphical representation of a difference between the estimated value of the second degree of freedom and a reference value of the second degree of freedom.

10. The method of claim 9, further comprising the step of:

in response to the second object detection signal, not driving the electrical motor with a motor drive signal.

11. The method of claim 9, further comprising the step of:

displaying a graphical representation of a difference between the estimated value of the first degree of freedom and the reference value of the first degree of freedom.

12. The method of claim 9, wherein:

the vehicle body comprises a dozer body;

the implement comprises a blade;

the first degree of freedom of the implement comprises a blade elevation; and the second degree of freedom of the implement comprises a blade slope angle.

13. The method of claim 12, wherein the at least one measurement unit comprises an inertial measurement unit mounted on the blade.

14. The method of claim 12, wherein the at least one measurement unit comprises an inertial measurement unit mounted on the vehicle body.

15. The method of claim 12, wherein the at least one measurement unit comprises:

a global navigation satellite system antenna mounted on the dozer body; and a global navigation satellite system receiver mounted on the dozer body.

16. The method of claim 12, wherein the at least one measurement unit comprises:

a global navigation satellite system antenna mounted on the blade; and a global navigation satellite system receiver mounted on the blade or on the dozer body.

* * * * *